US010486869B2

(12) United States Patent
Brook-Chrispin et al.

(10) Patent No.: US 10,486,869 B2
(45) Date of Patent: Nov. 26, 2019

(54) CLOSURE ARRANGEMENTS FOR LIQUID CONTAINERS, LIQUID CONTAINER ASSEMBLY, AND THE LIKE

(71) Applicant: Samantha Claire Brook-Chrispin, London (GB)

(72) Inventors: Samantha Claire Brook-Chrispin, London (GB); Kenneth Brook-Chrispin, Bradford (GB); Jon Mason, London (GB)

(73) Assignee: Samantha Claire Brook-Chrispin, London (GB)

( * ) Notice: Subject to any disclaimer, the term of this patent is extended or adjusted under 35 U.S.C. 154(b) by 739 days.

(21) Appl. No.: 14/652,053

(22) PCT Filed: Dec. 13, 2013

(86) PCT No.: PCT/GB2013/053297

§ 371 (c)(1),
(2) Date: Jun. 12, 2015

(87) PCT Pub. No.: WO2014/091248

PCT Pub. Date: Jun. 19, 2014

(65) Prior Publication Data

US 2015/0336722 A1 Nov. 26, 2015

(30) Foreign Application Priority Data

Dec. 14, 2012 (GB) ..... 1222658.5

(51) Int. Cl.
*B65D 51/28* (2006.01)
*B65D 83/00* (2006.01)

(52) U.S. Cl.
CPC ..... *B65D 51/2807* (2013.01); *B65D 51/28* (2013.01); *B65D 83/00* (2013.01)

(58) Field of Classification Search
CPC ..... B65D 51/2807; B65D 51/28; B65D 83/00
(Continued)

(56) References Cited

U.S. PATENT DOCUMENTS 3,220,588 A * 11/1965 Lipari ..... A61J 1/2093 206/222
3,378,168 A 4/1968 Hildebrandt
(Continued)

FOREIGN PATENT DOCUMENTS

DE 202004016982 U1 10/2005
EP 0534909 A1 3/1993
(Continued)

OTHER PUBLICATIONS

International Search Report (dated Jun. 23, 2014) for PCT/GB2013/053297, filed on Dec. 13, 2013.
(Continued)

*Primary Examiner* — Ernesto A Grano
(74) *Attorney, Agent, or Firm* — Innovation Capital Law Group, LLP; Vic Lin

(57) ABSTRACT

The present invention relates to closure arrangements for liquid containers, particularly but not exclusively for drinks bottles. A closure arrangement (20) for a liquid container for a base liquid comprises a reservoir (24A, 24B) for an additive liquid (28A, 28B). The closure arrangement (20) comprises a passage (54) for flow of liquid from the base liquid container (11) to a user, the passage including a mixing space (26) for mixing the additive liquid from the reservoir and the base liquid. The present invention further relates to a liquid container assembly including a closure arrangement. The present invention further relates to an additive reservoir for use in a closure arrangement.

21 Claims, 14 Drawing Sheets

(58) Field of Classification Search
USPC ..... 215/228
See application file for complete search history.

(56) References Cited

U.S. PATENT DOCUMENTS

| | | | | | |
|---|---|---|---|---|---|
| 3,747,791 | A * | 7/1973 | Fouser | A61J 9/00 | 215/11.1 |
| 5,035,320 | A | 7/1991 | Plone | | |
| 5,060,791 | A * | 10/1991 | Zulauf | B65D 81/3222 | 206/219 |
| 5,634,714 | A * | 6/1997 | Guild | A61J 1/2093 | 206/220 |
| 5,980,959 | A * | 11/1999 | Frutin | B65D 85/73 | 206/222 |
| 6,540,070 | B1 * | 4/2003 | Conwell | B65D 51/2828 | 206/219 |
| 6,935,493 | B2 * | 8/2005 | Cho | B65D 51/2835 | 206/222 |
| 6,959,841 | B2 * | 11/2005 | Vlodek | B65D 51/28 | 206/219 |
| 7,055,709 | B1 * | 6/2006 | Esau | A61J 7/0046 | 215/228 |
| 7,100,496 | B2 * | 9/2006 | Majer Doglioni | A47J 31/0642 | 426/433 |
| 8,152,008 | B2 * | 4/2012 | Cho | B05B 11/0083 | 215/227 |
| 8,893,925 | B2 * | 11/2014 | Cheetham | A61C 5/66 | 222/145.5 |
| 2002/0050461 | A1 * | 5/2002 | Vlodek | B65D 51/28 | 206/219 |
| 2006/0251771 | A1 * | 11/2006 | Yokota | B65D 51/2835 | 426/115 |
| 2007/0138179 | A1 | 6/2007 | Jacobs et al. | | |
| 2007/0253761 | A1 * | 11/2007 | May | B29C 45/0046 | 401/133 |
| 2008/0041738 | A1 * | 2/2008 | O'Donnell | B65D 51/2828 | 206/219 |
| 2008/0116086 | A1 * | 5/2008 | Hung | B65D 51/2835 | 206/222 |
| 2008/0135424 | A1 * | 6/2008 | Ostrowski | B65D 51/2828 | 206/221 |
| 2008/0202951 | A1 * | 8/2008 | Landolt | B65D 47/241 | 206/222 |
| 2011/0290677 | A1 | 12/2011 | Simonian et al. | | |
| 2012/0040018 | A1 * | 2/2012 | Thierman | A61K 36/9068 | 424/641 |

FOREIGN PATENT DOCUMENTS

| | | | |
|---|---|---|---|
| FR | 1485948 | A | 6/1967 |
| GB | 2201653 | A | 9/1988 |
| LU | 52263 | A | 5/1968 |
| WO | 02074647 | A1 | 9/2002 |
| WO | 2004089771 | A1 | 10/2004 |
| WO | 2007008082 | A1 | 1/2007 |
| WO | 2008104854 | A2 | 9/2008 |

OTHER PUBLICATIONS

Search and Examination Report (dated Nov. 15, 201) from GB1222658.5, filed Dec. 14, 2012.

Search and Examination Report (dated Jan. 7, 2014) from GB1322129.6.

* cited by examiner

SECTION D-D

SECTION C-C

SECTION E-E

SECTION F-F

SECTION G-G

SECTION H-H

SECTION J-J

CLOSURE ARRANGEMENTS FOR LIQUID CONTAINERS, LIQUID CONTAINER ASSEMBLY, AND THE LIKE

The present invention relates to closure arrangements for liquid containers, particularly but not exclusively for drinks bottles. The present invention further relates to a liquid container assembly including a closure arrangement. The present invention further relates to an additive reservoir for use in a closure arrangement.

Conventionally, it is known to provide bottle caps for soft drinks bottles which include a valve for regulating the flow of a liquid from the bottle.

Typically a soft drink comprises a base liquid, for example, water, which may be carbonated, to which an additive such as a liquid or soluble flavouring is added to form a finished product liquid. To ensure stability and long shelf life under varying environmental conditions of the finished product liquid, it is usually necessary to add one or more further additives such as stabilizers, preservatives, acidity regulators and flavour enhancers to the mixture of the base liquid and the flavouring. However, consumers are highly sensitive to the presence of additives. The small proportion of flavouring and additive relative to the large proportion of base liquid means that in the distribution chain, large volumes of finished product liquid have to be produced and stored for each flavouring.

In this specification, "upstream" means "before, in flow sequence".

According to a first aspect of the present invention, there is provided a closure arrangement for a liquid container for a base liquid, the closure arrangement comprising:

a reservoir for an additive liquid; and a passage for flow of liquid from the base liquid container to a user, the passage including a mixing space for mixing the additive liquid from the reservoir and the base liquid;

wherein the reservoir is collapsible.

By providing a collapsible additive reservoir the build-up of a pressure difference between the mixing space and the additive reservoir as the additive liquid flows out of the additive reservoir can be prevented. At the same time the reservoir can be sealed and leakage of the additive can be prevented. This can enable the closure arrangement to provide air exchange with the atmosphere, which in turn can assist in preventing the build-up of a pressure difference between the additive reservoir and the base liquid container.

Preferably the flows of additive liquid from the additive reservoir and base liquid from the base liquid container are directed to and mixed in the mixing space.

Preferably the collapsible additive reservoir is adapted such that it is collapsible under the influence of the user. Preferably the collapsible additive reservoir is adapted such that it is collapsible under the influence of user-induced flow through the passage. The user-induced flow through the passage may be induced by user suction, user force or user squeezing of the base liquid container, or by the user bringing the base liquid container into such a configuration that gravity causes a flow through the passage. Preferably the collapsible additive reservoir is adapted such that it is collapsible under a pressure difference of 0.1 kPa, or alternatively 0.5 kPa, or alternatively 1 kPa, or alternatively 5 kPa, or alternatively 10 kPa, or alternatively 50 kPa, or alternatively greater than or less than any of these pressure difference values.

Preferably the collapsible additive reservoir is collapsible such that the reservoir volume decreases as additive liquid flows out of the reservoir. Preferably the collapsible additive reservoir comprises at least a collapsible portion or a moveable part.

Preferably the collapsible additive reservoir is formed at least partially of a flexible material. Preferably the collapsible additive reservoir is formed of a thin walled material. The collapsible additive reservoir may be formed either of a resiliently deformable material or of a non-resiliently deformable material. Preferably the collapsible additive reservoir is in the form of a bag or a pouch. Preferably the closure arrangement further comprises a casing arranged to protect the collapsible additive reservoir. Preferably the casing is stiff and/or tough.

Alternatively the collapsible additive reservoir may be formed of a syringe with a plunger that is movable within the syringe.

Preferably the closure arrangement further comprises a regulator arrangement which is arranged to regulate the flows of the additive liquid and the base liquid to the mixing space.

Preferably the closure arrangement further comprises a closure arrangement valve which is arranged to regulate the flow of liquid through the passage. Preferably the mixing space is located upstream of the closure arrangement valve.

Possibly, the regulator arrangement is arranged so that the flows of the additive liquid and the base liquid are caused by a user providing a suction force at the closure arrangement valve passage.

Possibly, the regulator arrangement is arranged so that the flows of the additive liquid and the base liquid are associated or linked. Possibly, the association or linkage is direct, so that the flows increase or reduce together.

Possibly, the regulator arrangement is arranged to inhibit or prevent back flow of the base liquid and/or the additive liquid.

Possibly, the regulator arrangement includes a base liquid regulator. The base liquid regulator may include a one way base liquid valve which inhibits or prevents back flow of the base liquid into the interior. The base liquid regulator may include a one way base liquid valve which is arranged to inhibit or prevent back flow of liquid from the closure arrangement into the base liquid container. This can prevent cross-contamination between the additive reservoir and the base liquid container. Preferably the one way base liquid valve is adapted such that it opens under the influence of user-induced flow through the passage. Preferably the one way base liquid valve is adapted such that it opens under a pressure difference of 0.1 kPa, or alternatively 0.5 kPa, or alternatively 1 kPa, or alternatively 5 kPa, or alternatively 10 kPa, or alternatively 50 kPa, or alternatively greater than or less than any of these pressure difference values.

Possibly, the regulator arrangement includes an additive liquid regulator. The additive liquid regulator may include a one way additive liquid valve which inhibits or prevents back flow of the additive liquid into the reservoir. The additive liquid regulator may include a one way additive liquid valve which is arranged to inhibit or prevent back flow of liquid from the mixing space into the reservoir. This can prevent cross-contamination between the additive reservoir and the mixing space. This important feature may be provided independently and possibly in combination with any other feature described. Preferably the one way additive liquid valve is adapted such that it opens under the influence of user-induced flow through the passage. Preferably the one way additive liquid valve is adapted such that it opens under a pressure difference of 0.1 kPa, or alternatively 0.5 kPa, or alternatively 1 kPa, or alternatively 5 kPa, or alternatively 10 kPa, or alternatively 50 kPa, or alternatively greater than or less than any of these pressure difference values.

Possibly, the closure arrangement valve can be moved (is moveable) between an open and a closed condition.

The closure arrangement may include a plurality of additive reservoirs, each of which may store different additive liquids, and the regulator arrangement may include a corresponding plurality of additive liquid regulators.

Possibly, the regulator arrangement includes an adjuster, which in use permits a user to adjust the amount of additive liquid(s) added to the base liquid in the mixing space (to adjust the volume ratio of the total additive liquid(s) relative to the base liquid).

Possibly, the volume ratio of the total additive liquid(s) relative to the base liquid is predetermined. The volume ratio may be fixed, or may be adjustable by means of the adjuster. The adjuster may be adjustable between a no flow condition, in which no additive liquids are added to the base liquid and/or a low flow condition and/or a full flow condition.

The volume ratio may be no more than 1:50, more desirably no more than 1:200 and optimally no more than 1:250. Possibly, when the volume ratio is fixed, the volume ratio is not less than 1:500, more desirably not less than 1:375 and optimally not less than 300.

Possibly, the closure arrangement includes one or more additive liquid communication tubes, one of which may extend between the or each reservoir and the or each additive liquid regulator. Possibly the tube is formed of a resiliently deformable material.

Possibly, the adjuster is arranged in use to permit a user to adjust the amount of all of the additive liquids together which are added to the base liquid in the mixing space, so that the flow ratio of the different additive liquids stays substantially the same at different flow rates. Possibly, the adjuster permits adjustment of the flow of the additive liquid(s) between a no flow condition and a full flow condition.

Possibly, the adjuster includes an adjuster gate formation, which may be arranged to selectively deform the or one of the tubes to permit substantially no additive liquid flow in the no flow condition and a full additive liquid flow in the full flow condition. Preferably the adjuster gate formation is an annular projection. Preferably the adjuster gate formation is rotatably mounted to the closure arrangement, for rotational movement relative to the additive liquid communication tubes about the central axis of the closure arrangement. Preferably the adjuster gate formation is mounted to the closure arrangement such that rotation causes the adjuster gate formation to move along the central axis of the closure arrangement. Preferably the position of the adjuster gate formation is continuously variable. This can enable continuously variable adjustment, which can provide the advantage of not limiting the user to a discreet number of pre-set adjustment options, but instead enabling the user to freely select a preferred adjustment. This important feature may be provided independently and possibly in combination with any other feature described.

Possibly, the closure arrangement is reusable. Possibly, the or each reservoir can hold sufficient additive liquid for addition to a plurality of bottles (containers) of base liquid.

Possibly, the base liquid valve is a duckbill valve, an umbrella valve, a cross slit valve, a belleville valve, a dome valve or any other suitable one way valve. More possibly, the base liquid valve is a duckbill valve.

Possibly, the or each additive liquid valve is a duckbill valve, an umbrella valve, a cross slit valve, a belleville valve, a dome valve or any other suitable one way valve. More possibly, the or each additive liquid valve is a duckbill valve.

Possibly, the closure arrangement includes a relief valve to permit the equalisation of pressure in the interior during use. Possibly, the closure arrangement includes a relief valve which is arranged to permit the equalisation of pressure between the atmosphere and the base liquid container. Preferably the casing is such that air exchange between the casing body space and the atmosphere can occur. Possibly, the relief valve is a one way valve.

Possibly, the (base) liquid container defines an interior in which, in use, the base liquid is located, and an opening for charging and discharging the base liquid into and out of the interior. Possibly, the closure arrangement provides a closure to the opening to retain the base liquid in the interior.

Preferably the base liquid container defines an opening for charging and discharging the base liquid into and out of the base liquid container, and the closure arrangement provides a closure to the opening to retain the base liquid in the base liquid container.

Possibly, the closure arrangement is a liquid container closure arrangement, and may be a drink or beverage container closure arrangement. Possibly, the liquid container is a drinks bottle. Possibly, the closure arrangement is in the form of a cap or a bottle topper or a bottle spout.

Possibly, the closure arrangement includes two additive liquid reservoirs. In use, one reservoir may contain a first additive liquid, which may be a flavouring or a flavouring concentrate. In use, the other reservoir may contain a second additive liquid, which may be a flavour enhancer and/or a preservative, and may be phosphoric acid. The ratio of the volume amount of the first additive liquid to the second additive liquid may be predetermined, and may be substantially 1:1.

Preferably there is one reservoir that contains a first additive liquid, which may be a flavouring or a flavouring concentrate. Preferably there is a second reservoir that contains a second additive liquid, which may be a second flavouring or a second flavouring concentrate, and preferably in which the ratio of the volume amount of the first additive liquid to the second additive liquid is user-adjustable.

According to a second aspect of the present invention, there is provided a closure arrangement for a liquid container for a base liquid, the closure arrangement comprising:

a reservoir for an additive liquid;

a passage for flow of liquid from the base liquid container to a user, the passage including a mixing space for mixing the additive liquid from the reservoir and the base liquid; and a one way additive liquid valve which is arranged to inhibit or prevent back flow of liquid from the mixing space into the reservoir.

By providing a one way additive liquid valve contamination of the additive liquid in the reservoir can be prevented. This can enable multiple use of the closure arrangement over an extended period.

According to a further aspect of the present invention, there is provided a closure arrangement for a liquid container for a base liquid, the closure arrangement comprising:

a reservoir for an additive liquid;

a passage for flow of liquid from the base liquid container to a user, the passage including a mixing space for mixing the additive liquid from the reservoir and the base liquid; and an adjuster arranged to adjust the amount of additive liquid added to the base liquid in the mixing space such that the adjustment is continuously variable.

Preferably the adjuster is arranged to adjust the volume ratio of the additive liquid relative to the base liquid. Preferably the adjuster is arranged to adjust the flow ratio of the additive liquid and the base liquid. Preferably the adjuster is arranged for continuously variable adjustment. This can provide the advantage of not limiting the user to a discreet number of pre-set adjustment options, but instead enabling the user to freely select a preferred adjustment.

According to a further aspect of the present invention, there is provided a closure arrangement for a liquid container, the liquid container containing, in use, a base liquid, the closure arrangement defining a passage and including a closure arrangement valve for regulating the flow of liquid through the passage, the closure arrangement defining an additive reservoir in which, in use, an additive liquid is located, the closure arrangement further defining a mixing space in which in use the additive liquid is added to the base liquid and which is located upstream of the closure arrangement valve, the closure arrangement including a regulator arrangement which regulates the flows of the additive liquid and the base liquid to the mixing space.

According to a yet further aspect of the present invention, there is provided a liquid container assembly, the assembly including a liquid container for a base liquid and a closure arrangement as described above.

According to a yet further aspect of the present invention, there is provided a collapsible additive reservoir for use in a closure arrangement as described above.

According to a yet further aspect of the present invention, there is provided a kit of parts with at least one additive reservoir as described above and a closure arrangement as described above and optionally a liquid container for a base liquid.

According to another aspect of the present invention, there is provided a liquid container assembly, the assembly including a liquid container and a closure arrangement, the liquid container containing, in use, a base liquid, the closure arrangement defining a passage and including a closure arrangement valve for regulating the flow of liquid through the passage, the closure arrangement defining an additive reservoir in which, in use, an additive liquid is located, the closure arrangement further defining a mixing space in which in use the additive liquid is added to the base liquid and which is located upstream of the closure arrangement valve, the closure arrangement including a regulator arrangement which regulates the flows of the additive liquid and the base liquid to the mixing space.

According to another aspect of the present invention there is provided a method of dispensing liquid from a liquid container, the method including providing a closure arrangement for the liquid container, the liquid container containing, in use, a base liquid, the closure arrangement comprising a reservoir for an additive liquid and a passage for flow of liquid from the base liquid container to a user, the passage including a mixing space for mixing the additive liquid from the reservoir and the base liquid, the reservoir preferably being collapsible, the closure arrangement preferably including a one way additive liquid valve which is arranged to inhibit or prevent back flow of liquid from the mixing space into the reservoir, and/or the closure arrangement preferably including an adjuster arranged to adjust the amount of additive liquid added to the base liquid in the mixing space such that the adjustment is continuously variable.

According to a further aspect of the present invention there is provided a method of dispensing liquid from a liquid container, the method including providing a closure arrangement for the liquid container, the liquid container containing, in use, a base liquid, the closure arrangement defining a passage and including a closure arrangement valve for regulating the flow of liquid through the passage, the closure arrangement defining an additive reservoir in which, in use, an additive liquid is located, the closure arrangement further defining a mixing space in which in use the additive liquid is added to the base liquid and which is located upstream of the closure arrangement valve, the closure arrangement including a regulator arrangement which regulates the flows of the additive liquid and the base liquid to the mixing space.

Possibly, the closure arrangement includes any of the features described in the paragraphs above. Possibly, the method includes any of the steps described in any of the paragraphs above.

The invention extends to methods and/or apparatus substantially as herein described with reference to the accompanying drawings.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination. As used herein, means plus function features may be expressed alternatively in terms of their corresponding structure, It should also be appreciated that particular combinations of the various features described and defined in any aspects of the invention can be implemented and/or supplied and/or used independently.

Embodiments of the present invention will now be described, by way of example only, and with reference to the accompanying drawings, in which:—

Figure 1:
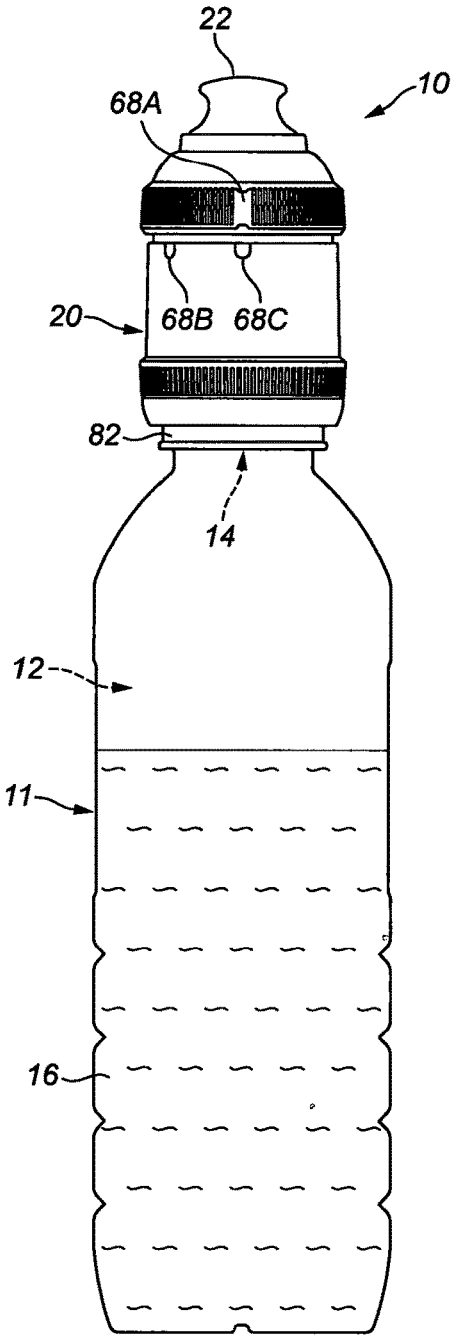
FIG. 1 is a side view of a liquid container assembly according to the invention, including a closure arrangement and a liquid container.
Figure 2:
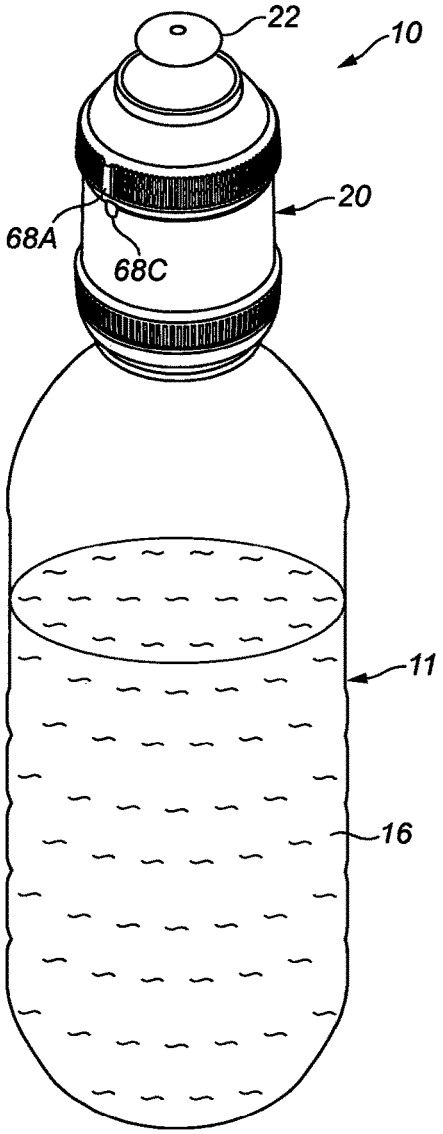
FIG. 2 is a perspective view of the assembly of FIG. 1.
Figures 3A, 3B, 3C, 3D, 3E:
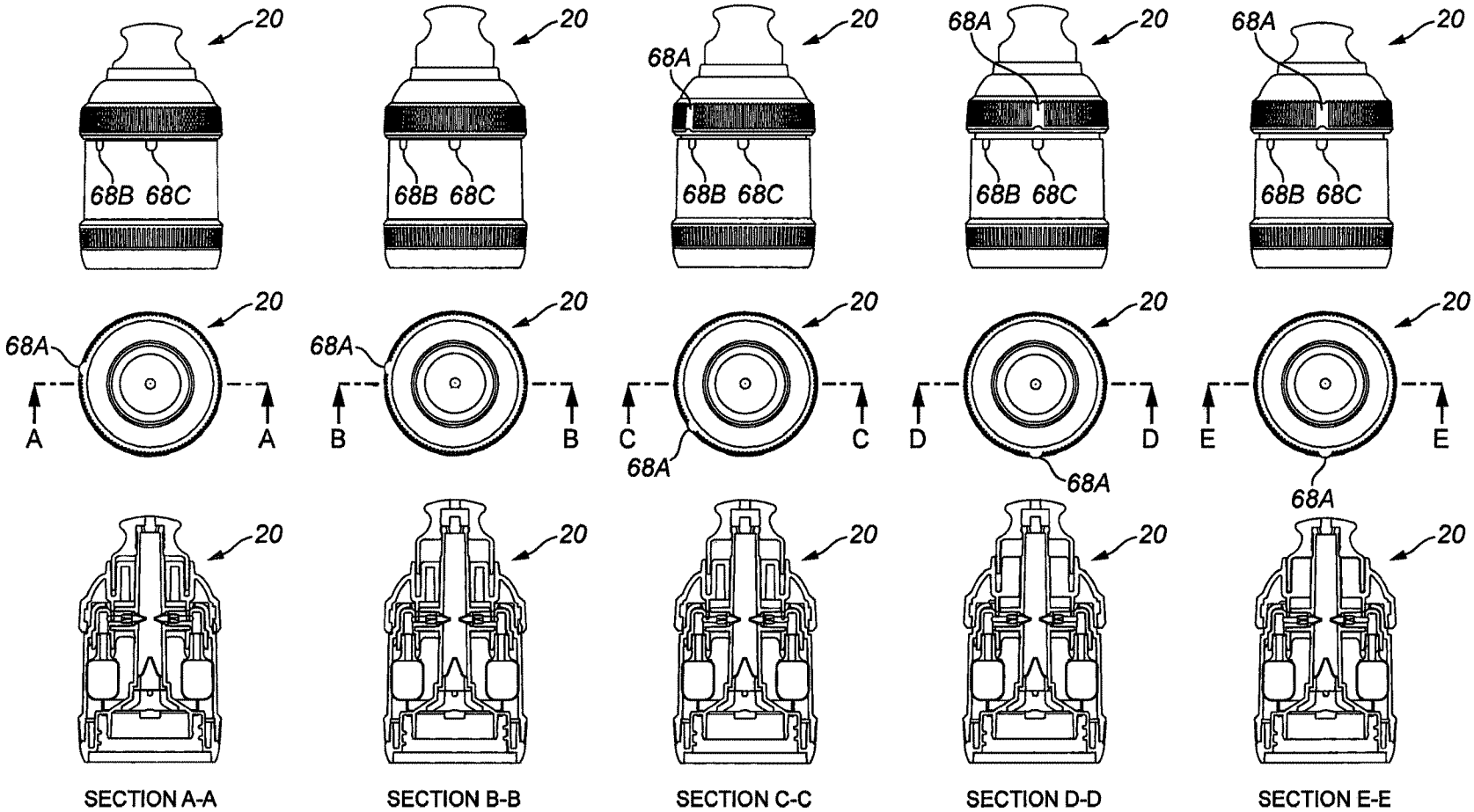
Figure 5A:
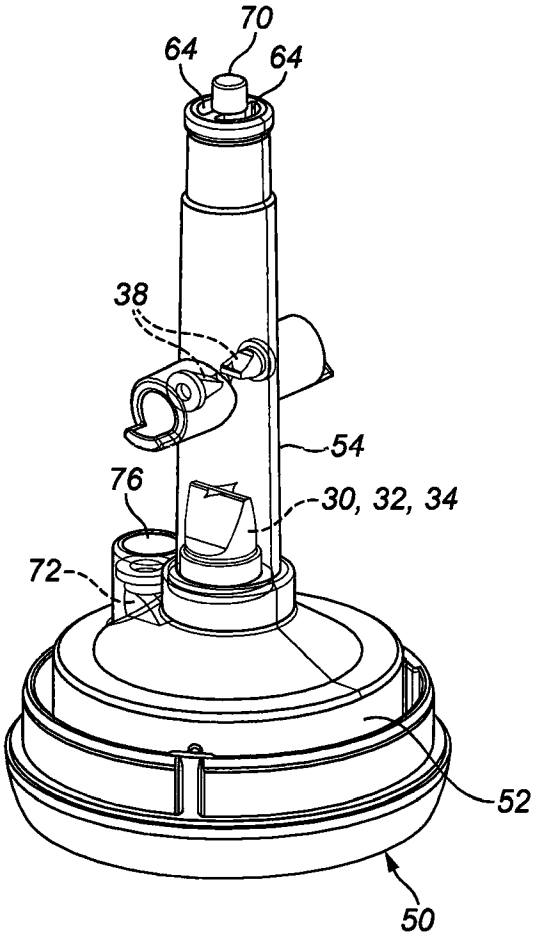
Figure 6A:
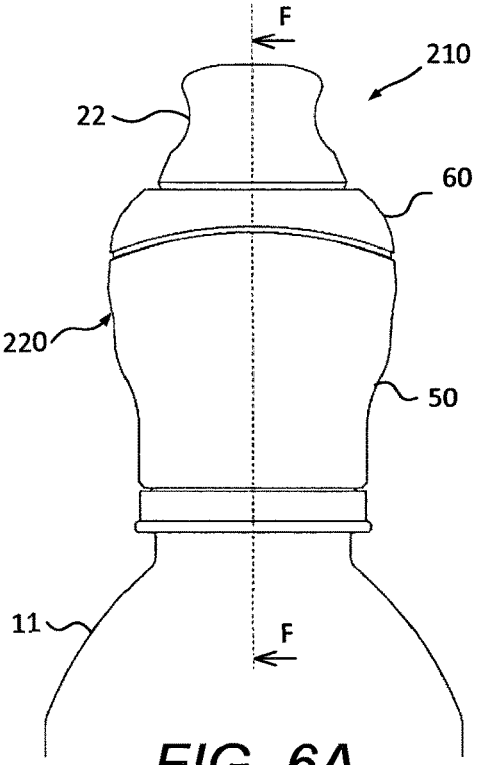
Figure 6B:
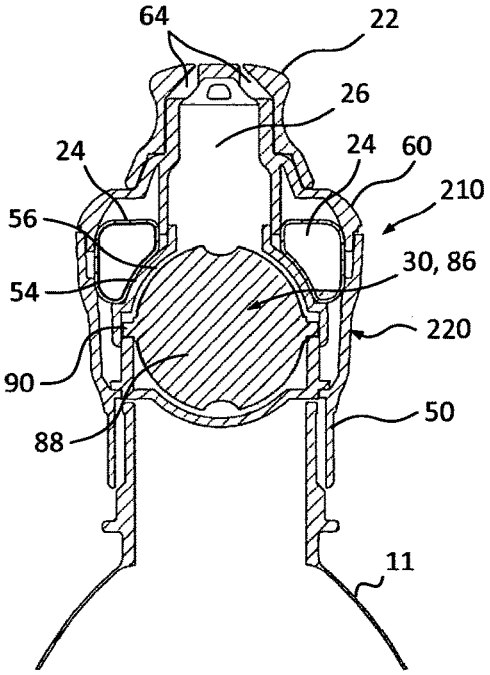
Figure 7A:
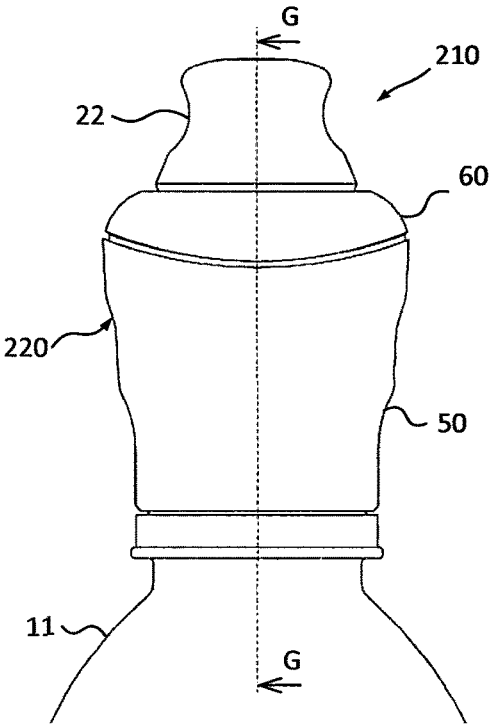
Figure 7B:
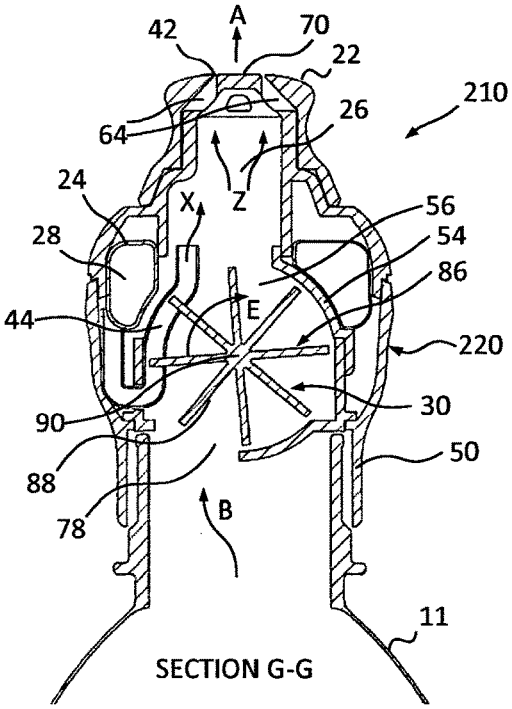
Figure 8:
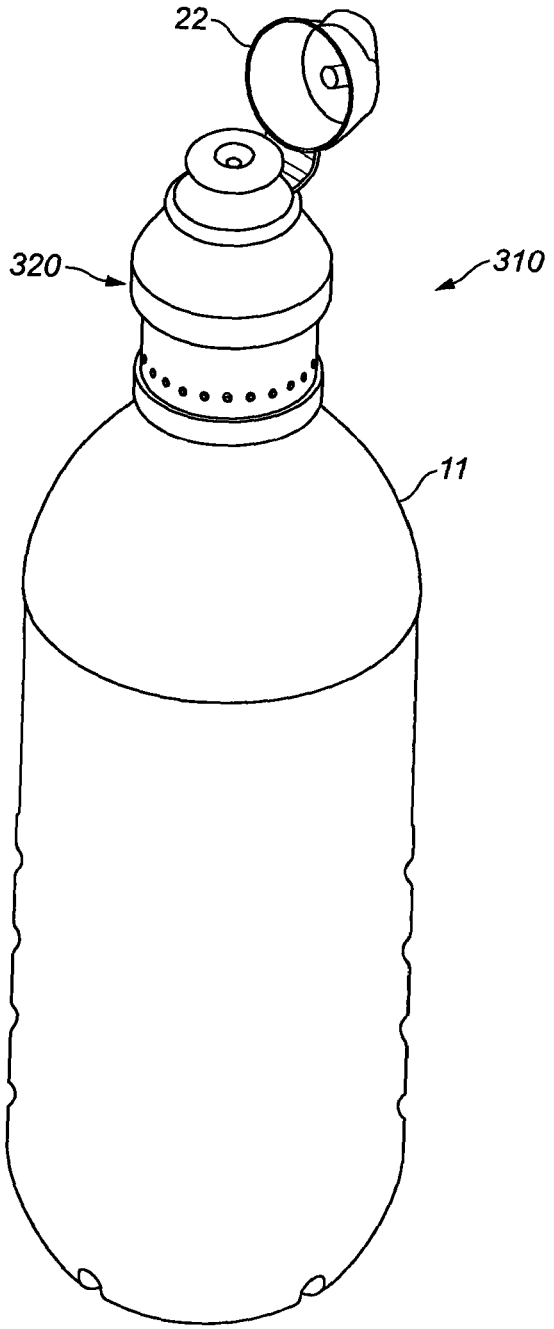
Figure 9B:
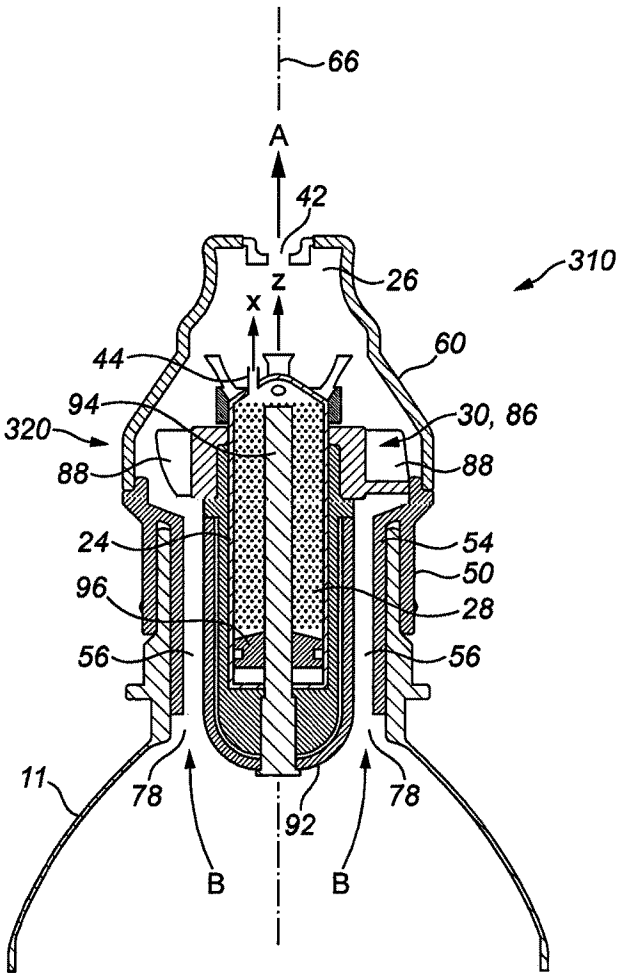
Figure 9A:
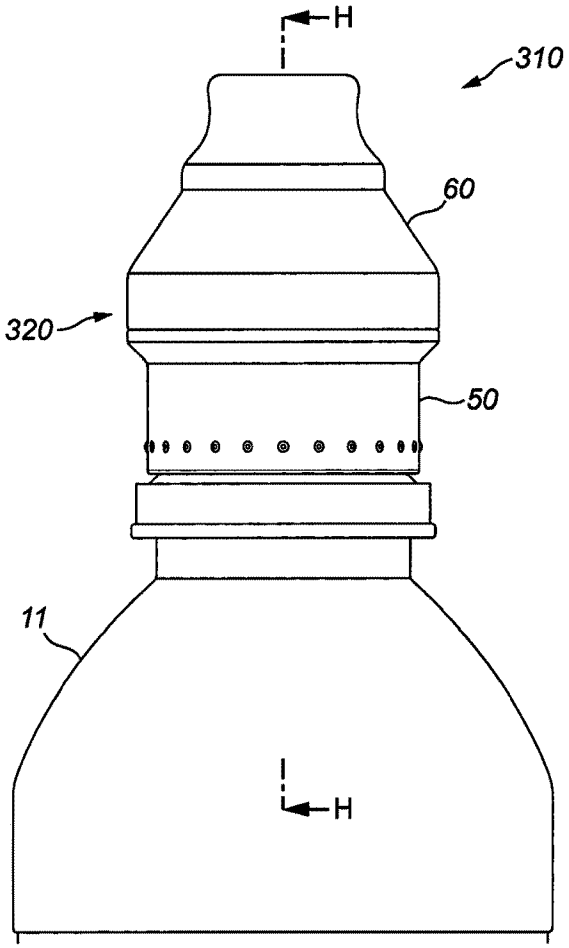
Figure 10B:
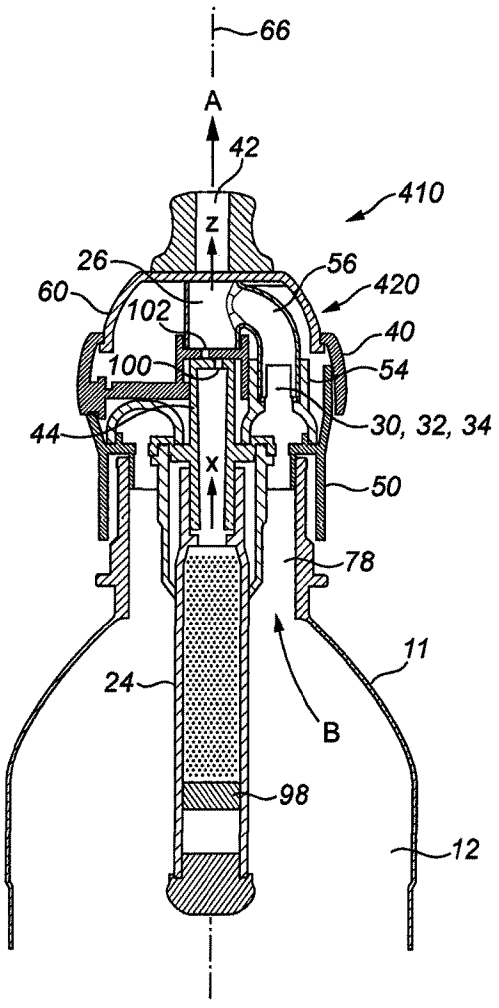
Figure 10A:
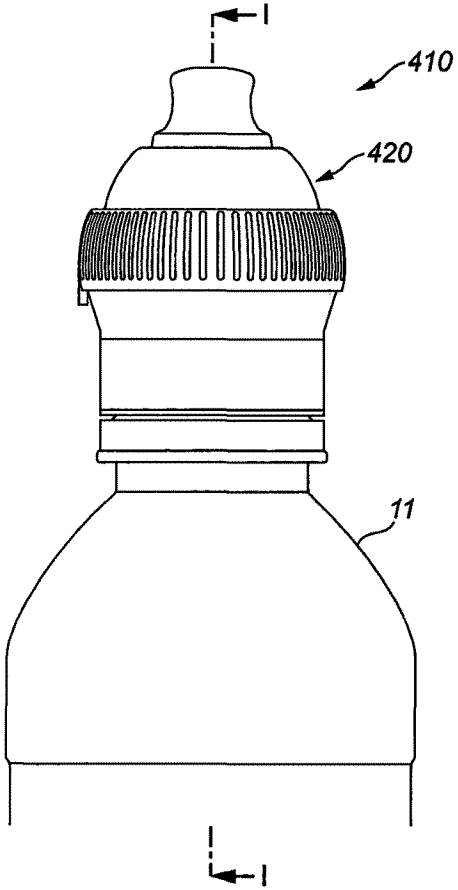
Figure 11B:
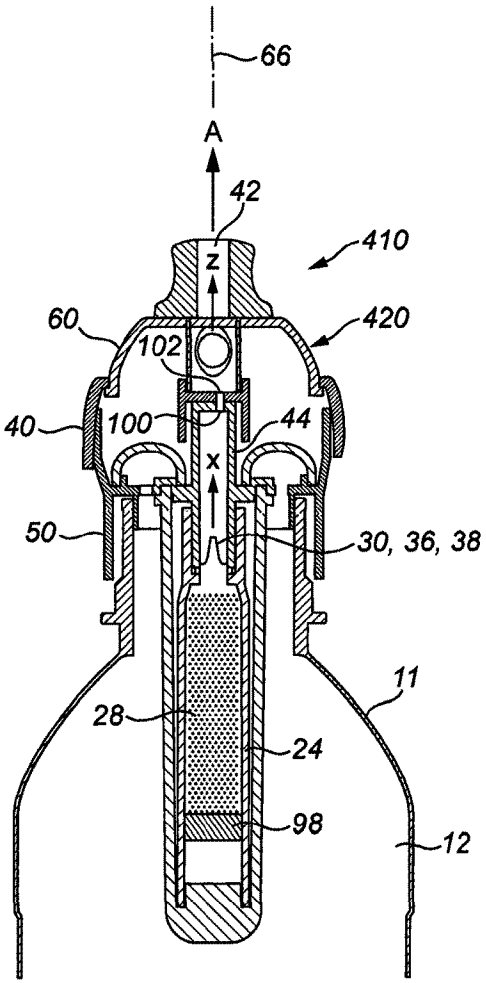
Figure 11A:
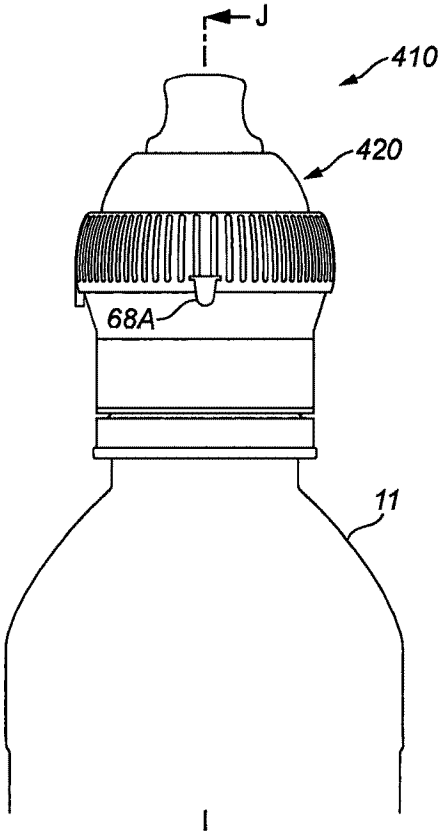
Figure 13A:
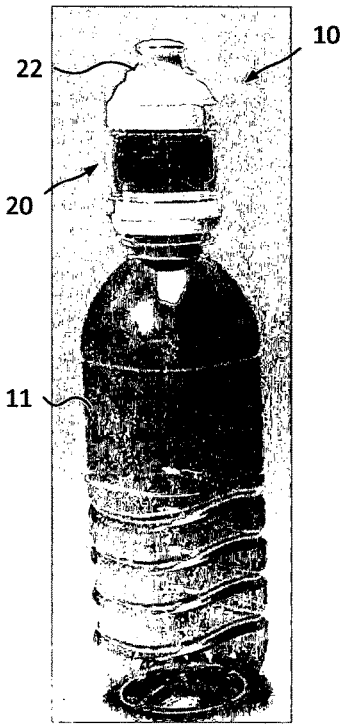
Figure 13B:
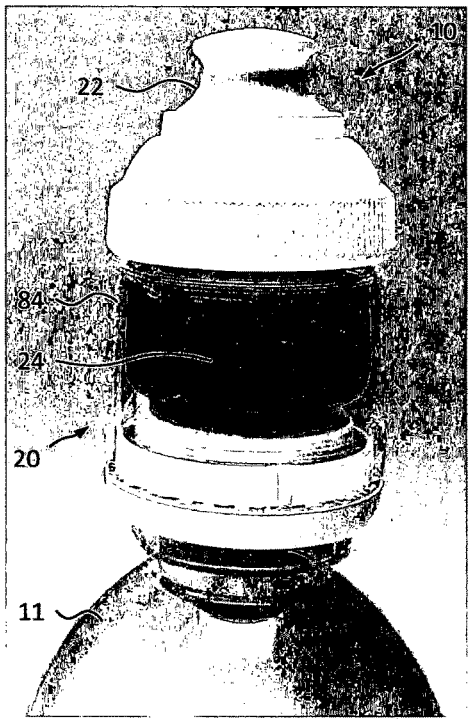
Figure 14A:
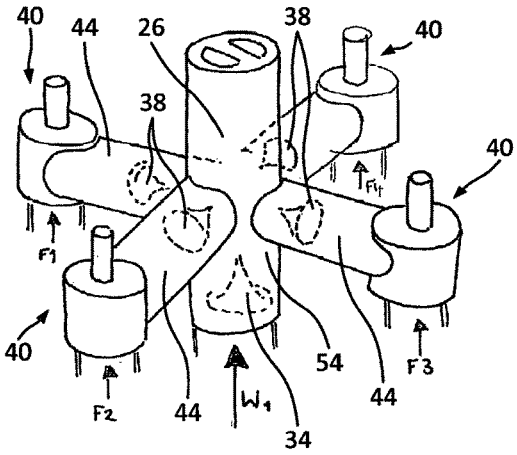
Figure 14B:
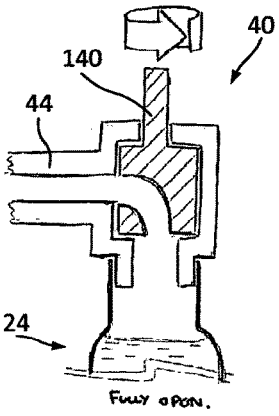
Figure 14C:
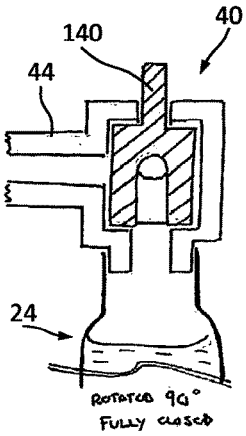
Figure 15A:
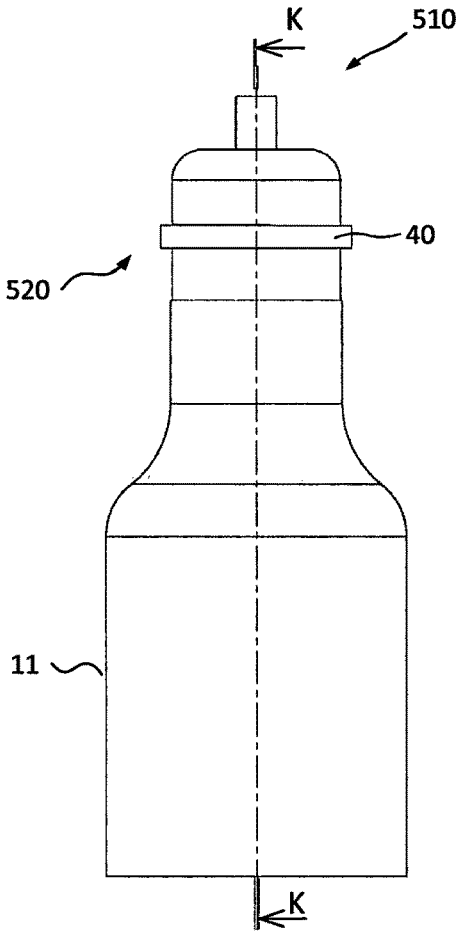
Figure 15B:
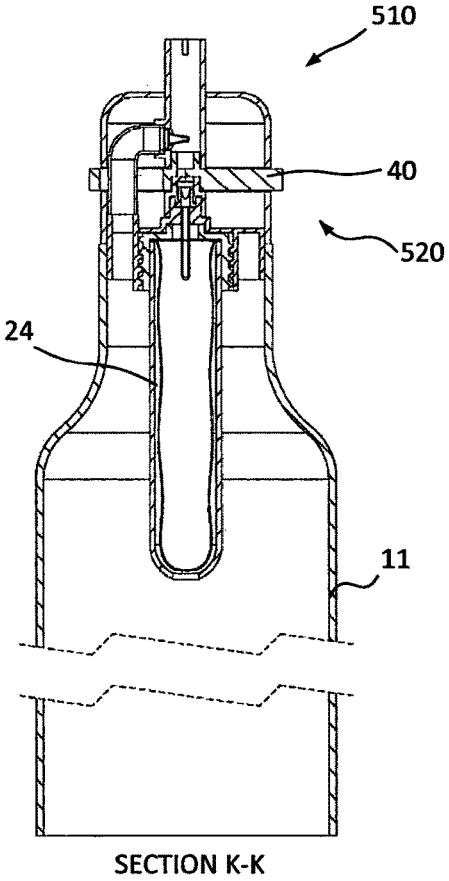
Figure 15C:
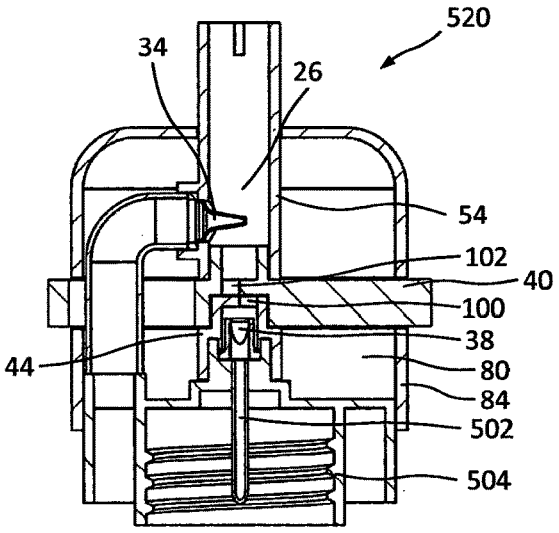
Figure 15D:
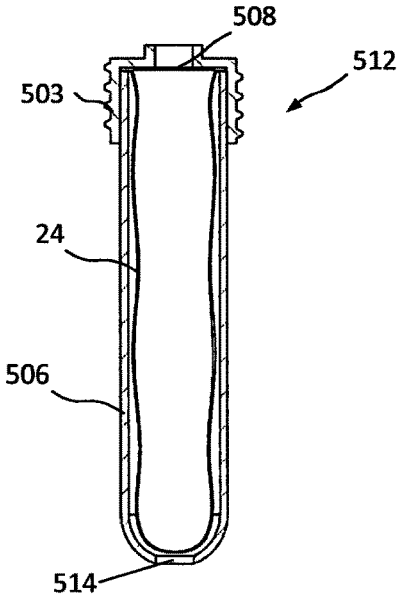

FIGS. 3A to 3E each include a side view, a plan view and a side sectional view (the section view being indicated on the plan view in each case) of the closure arrangement of FIGS. 1 and 2 in different operating conditions;

FIGS. 4A to 4E are side sectional views of the closure arrangement of FIGS. 1 to 3 enlarged for clarity and corresponding to the side sectional views of FIGS. 3A to 3E;

FIGS. 5A to 5E are perspective views of, respectively, a connection part of the closure arrangement, an adjuster of the closure arrangement, a body part of the closure arrangement, the adjuster again from a different angle, and a sub assembly comprising the adjuster mounted to the a body part;

FIGS. 6A and 6B are respectively a side and a cross sectional view of a second liquid container assembly according to the invention;

FIGS. 7A and 7B are respectively another side and another cross sectional view of the second liquid container assembly;

FIG. 8 is a perspective view of a third liquid container assembly according to the invention;

FIGS. 9A and 9B are respectively a side and a cross sectional view of the third liquid container assembly;

FIGS. 10A and 10B are respectively a side and a cross sectional view of a fourth liquid container assembly according to the invention;

FIGS. 11A and 11B are respectively another side and another cross sectional view of the fourth liquid container assembly;

FIGS. 12A to 12G are, respectively, a cross sectional view of the connection part of FIG. 5A, a perspective and a cross sectional view of an additive liquid communication tube, a cross sectional view of the connection part with the additive liquid communication tubes, perspective views of reservoirs in two different configurations, and a perspective view of the connection part with the reservoir;

FIGS. 13A and 13B are perspective views of, respectively of a liquid container assembly including a liquid container with a transparent casing, and the closure arrangement in more detail;

FIGS. 14A to 14C are, respectively, a perspective view of the a closure arrangement with four reservoirs, a cross sectional view of an adjuster of FIG. 14A in a connecting configuration, and a cross sectional view of an adjuster of FIG. 14A in a blocking configuration; and FIGS. 15A to 15D are, respectively, a side and a cross sectional view of a fifth liquid container assembly according to the invention, a cross sectional view of the closure arrangement of FIG. 15A, and a cross sectional view of the additive capsule of FIG. 15A.

FIGS. 1 to 5 and 12 show a first embodiment of the invention. A liquid container assembly 10 includes a liquid container 11 and a closure arrangement 20 in the form of a cap. The liquid container 11 defines an interior 12 (the dotted reference lines in FIG. 1 indicate the general whereabouts of the interior 12 which is hidden in FIG. 1) in which, in use, a base liquid 16 is located and an opening 14 (the dotted reference lines in FIG. 1 again indicating the general whereabouts of the opening 14 which is hidden in FIG. 1) for charging and discharging the base liquid 16 into and out of the interior 12.

The closure arrangement 20 provides a closure to the opening 14 to retain the base liquid 16 in the interior 12. The closure arrangement 20 includes a closure arrangement valve 22 for regulating the flow of the base liquid 16 through the opening 14.

In this embodiment, the closure arrangement 20 defines a pair of additive reservoirs 24A, 24B in each of which, in use, an additive liquid 28A, 28B is located. The additive reservoirs 24 could be formed of a resiliently deformable material, and could be formed of thermoplastic elastomer (TPE). The additive reservoirs 28A, 28B could be lined with foil, and could be in the form of bags or pouches. The foil lining provides additional resistance to acidic and concentrated liquids.

The closure arrangement 20 further defines a mixing space 26 in which in use the additive liquids 28A, 28B are added to the base liquid 16 and which is located upstream of the valve 22. The closure arrangement 20 includes a regulator arrangement 30 which regulates the flows of the additive liquids 28A, 28B and the base liquid 16 to the mixing space 26.

The closure arrangement 20 further comprises: a connection part 50 for connection to the liquid container 11; and a body part 60.

The connection part 50 comprises a threaded part 52 for receiving and threadably engaging a correspondingly threaded neck part 82 of the liquid container 11. The threaded part 52 defines an inlet space 78 in which the neck part 82 is receivable. The connection part 50 includes a passage part 54 which defines a body passage 56 which extends along a central axis 66 through the closure arrangement 20 to outlet passages 64 defined in an end wall of the passage part 54 which communicate with a closure arrangement valve passage 42 defined by the closure arrangement valve 22.

The body part 60 includes a casing 84 which defines a body space 80 therein. The casing 84 is seated on the connection part 50. The casing 84 is relatively stiff and tough and is formed from plastics material, and protects the components in the body space 80.

FIG. 5 shows the connection part 50. The connection part 50 includes a one way relief valve 72 which is located in a passage 76 defined by the threaded part 52. The passage 76 extends between the inlet space 78 and the body space 80 outside of the passage part 54. The one way relief valve 72 permits air movement from the body space 80 to the inlet space 78, but substantially prevents movement of liquid from the inlet space 78 into the body space 80.

The regulator arrangement 30 includes a base liquid regulator 32 which includes a one way base liquid valve 34 which inhibits or prevents back flow of the base liquid 16 into the interior 12.

The base liquid valve 34 also prevents back flow of the additive liquid 28 from the mixing space 26 back into the interior 12 and thus prevents fouling of the base liquid 16. It is important, in particular in order to provide the base liquid 16 without additive liquid 28, to prevent contamination of the base liquid 16 in the interior 12 by the additive liquid 28.

In this embodiment, the base liquid valve 34 is a duckbill valve and could be formed of a resiliently deformable material. In one example, the duckbill valve 34 could be formed of a thermoplastic elastomer (TPE).

The duckbill valve 34 is such that suction applied from the user's mouth is sufficient to open the duckbill valve 34. For example, a minimum pressure of 0.5 kPa can suffice to open the duckbill valve 34 and thus open the base liquid regulator 32. The suction applied from the user's mouth can reach 20 kPa or more.

In other examples, the base liquid valve 34 could be an umbrella valve, a cross slit valve, a belleville valve, a dome valve or any other suitable one way valve.

The regulator arrangement 30 includes a pair of additive liquid regulators 36A, 36B, each of which includes, respectively, a one way additive liquid valve 38A, 38B which inhibits or prevents back flow of the respective additive liquid 28A, 28B into the respective reservoir 24A, 24B.

The additive liquid regulators 36A, 36B also prevent back flow of the base liquid 16 into the reservoirs 24A, 24B and thus prevent fouling of the reservoirs 24A, 24B. In particular for extended use of the closure arrangement it is important to prevent contamination of the additive liquid 28 in the reservoir 24.

In this embodiment, the additive liquid valves 38A, 38B are duckbill valves and could be formed of a resiliently deformable material. In one example, the duckbill valves 38A, 38B could be formed of a thermoplastic elastomer (TPE).

The duckbill valves 38A, 38B are such that suction applied from the user's mouth is sufficient to open the duckbill valves 38A, 38B. For example, a minimum pressure of 0.5 kPa can suffice to open the duckbill valves 38A, 38B and thus open the additive liquid regulators 36A, 36B. The suction applied from the user's mouth can reach 20 kPa or more.

In other examples, each of the additive liquid valves 38 could be an umbrella valve, a cross slit valve, a belleville valve, a dome valve or any other suitable one way valve or any arrangement which provides a functional equivalent of a one way valve.

The closure arrangement 20 includes a pair of additive liquid communication tubes 44A, 44B, one of which extends between each respective reservoir 24A, 24B and the respective additive liquid regulator 36A, 36B. Each tube 44A, 44B could be formed of a resiliently deformable material, such as TPE. In one example, each tube 44A, 44B could be in the form of a 90° elbow.

The regulator arrangement 30 includes an adjuster 40. As shown most clearly in FIGS. 5B to 5E, the adjuster 40 includes a gate formation 46 in the form of a relatively short projecting tube. The adjuster 40 is mounted to the passage part 54 and the body part 60, for rotational movement relative to the passage part 54 and the body part 60 about the central axis 66.

As shown in FIGS. 5B to 5E, the adjuster 40 includes a guide 48 which guides the movement of the adjuster 40 relative to the body part 60. The adjuster 40 defines three guide channels 49 on an inside wall thereof, which extend circumferentially around the inside wall and slightly axially, to provide a somewhat helical form. The guide channels 49 are separated from each other by inside wall parts which form guide limits 49. Three corresponding guide engaging lugs 104 project outwardly from the body part 60, each lug 104 locating in an assembled condition in a corresponding one of the guide channels 106.

The effect of the guide 48 is that as the adjuster 40 is rotated, the adjuster 40 also moves along the axis 66 towards or away from the body part 60. As the adjuster 40 moves towards or away from the body part 60, the adjuster gate formation 46 moves relative to the additive liquid communication tubes 44A, 44B to selectively deform both of the tubes 44A, 44B to permit substantially no additive liquid flow in a no flow condition and a full additive liquid flow in a full flow condition.

Thus, as the adjuster 40 is moved, the adjuster gate formation 46 moves relative to each tube 44A, 44B by substantially the same amount, permitting the user to adjust the amounts of all of the additive liquids 28 which are added to the base liquid 16 in the mixing space 26 together and substantially equally, so that the relative ratio of the different additive liquids 28 stays substantially the same.

The guide limits 49 limit the movement of the adjuster 40 relative to the body part 60.

The adjuster 40 and the body part 60 include markings 68, which when aligned indicate the relative positions of the adjuster 40 and the body part 60 in a no flow condition, a low flow condition and the full flow condition, as will be discussed in more detail below. The markings 68 include an adjuster marking 68A, a first body part marking 68B, a second body part marking 68C and a third body part marking 68D. When the adjuster marking 68A is aligned with the third body part marking 68D, the adjuster 40 is in the no flow condition. When the adjuster marking 68A is aligned with the first body part marking 68B, the adjuster 40 is in the low flow condition, and when the adjuster marking 68A is aligned with the second body part marking 68C, the adjuster 40 is in the full flow condition.

The closure arrangement valve 22 is movable relative to the passage part 54 along the axis 66 between an open condition and a closed condition. The closure arrangement valve 22 defines a closure arrangement valve passage 42. The passage part 54 includes a projection 70, which in the closed condition is received within the closure arrangement valve passage 42 to close the closure arrangement valve passage 42 and prevent the passage of liquid therethrough. In the closed condition, the outlet passages 64 are also blocked by the abutment of the closure arrangement valve 22 to the passage part 54. As the closure arrangement valve 22 is moved to the open condition, it moves along the axis 66 away from the passage part 54 unblocking the outlet passages 64 and the closure arrangement valve passage 42 opens as it moves clear of the projection 70, permitting passage of liquid from the mixing space 26 through the closure arrangement valve passage 42.

FIGS. 12A to 12G show the internal parts of the closure arrangement 20 in more detail.

Figure 12A:
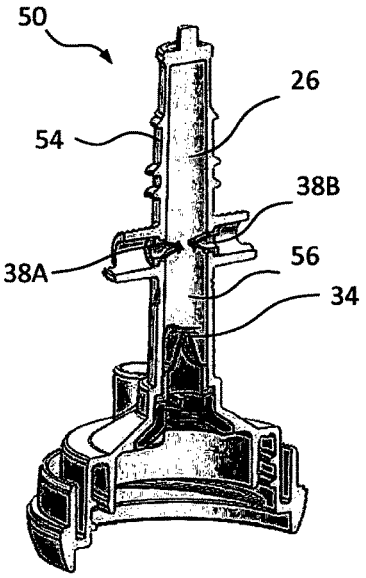

FIG. 12A shows a cross sectional view of the connection part 50 including the passage part 54. The additive liquid valves 38A, 38B are arranged such that their outlets project into the body passage 56 defined by the passage part 54. This can assist in creating flow acceleration in the mixing space 26 and thus assist in drawing out the additive liquid 28. This can also promote turbulent flow in the mixing space 26 and thus assist in mixing the additive liquid 28 with the base liquid 16. The base liquid valve 34 is arranged in the body passage 56 upstream of where the additive liquid valves 38A, 38B project into the body passage 56.

Figure 12B:
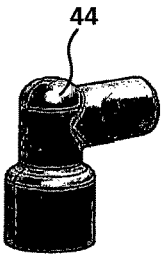
Figure 12C:
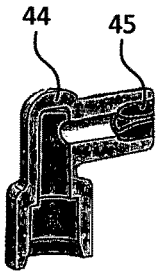

The connection part 50 provides a sleeve for insertion of the additive liquid communication tubes 44A, 44B. FIGS. 12B and 12C show a perspective and a cross sectional view of an additive liquid communication tube 44. At the outlet of the additive liquid communication tube 44 a pinhole outlet 45 is provided.

The pinhole outlet 45 is appropriate for very high concentration additive liquids 28, in order to ensure that the volume of additive liquid 28 exiting into the mixing space 26 is relatively small. In the case of lower concentration additive liquids 28 the pinhole outlet part 45 can be omitted. The additive liquid communication tubes 44 can have an outlet diameter of approximately 1 mm and the pinhole outlet 45 can have an outlet diameter of approximately 0.1 mm for a concentrate intended for dilution at approximately 1:200. A smaller diameter may be preferable for higher concentration additive liquids 28. The pinhole outlet 45 is such that only the outlet portion is restricted to the narrow outlet diameter, and the rest of the additive liquid communication tubes 44 are wider. The additive liquid conduit can reduce the flow area to the pinhole outlet 45 along a distance of approximately 5 mm. This can enable low fluid resistance for travel through the additive liquid communication tubes 44, thus ensuring the user is not require to apply excessive suction.

Figure 12D:
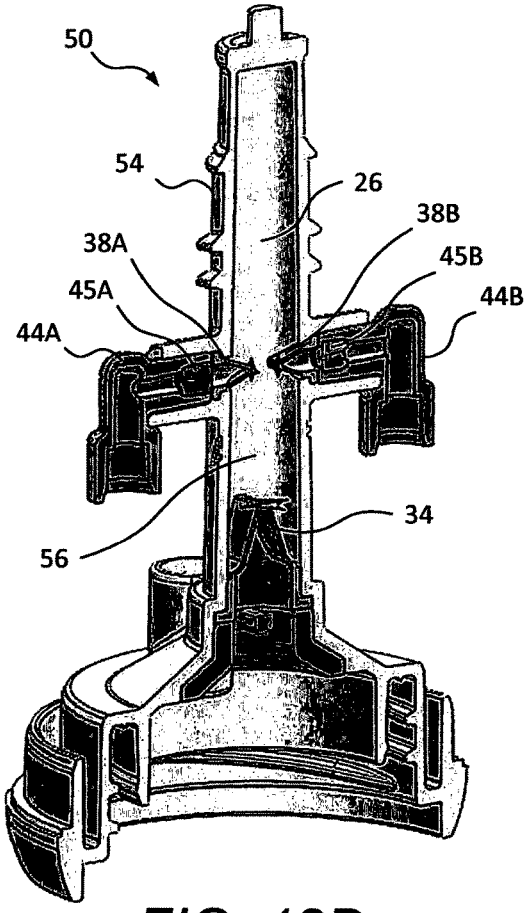

FIG. 12D shows a cross sectional view of the connection part 50 with the additive liquid communication tubes 44A, 44B inserted in the sleeves for insertion and connected to the passage part 54.

The pinhole outlet 45 further provides the advantage that capillary forces are prevalent at the outlet of the additive liquid communication tubes 44, and the additive liquid in the additive liquid communication tubes 44 forms a meniscus at the pinhole outlet 45. This can assist the additive liquids 28 to be readily available even if the liquid container 11 and the closure arrangement 20 are arbitrarily handled (e.g. shaken) prior to use.

Figure 12E:
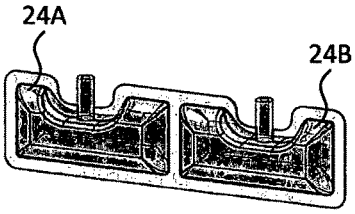
Figure 12F:
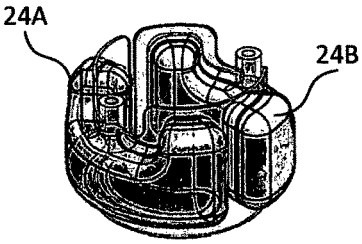

FIGS. 12E and 12F show the flexible, thin walled, collapsible reservoirs 24 in two different configurations. In this example the two different reservoirs 24A, 24B are joined in a single part that is flexible and can be shaped so that the reservoir outlets are arranged for connection to the additive liquid communication tubes 44A, 44B, as shown in FIG. 12F. The reservoir 24 may be annular or part-annular in shape, preferably to conform to the circular cross-sectional shape of the closure arrangement 20.

Figure 12G:
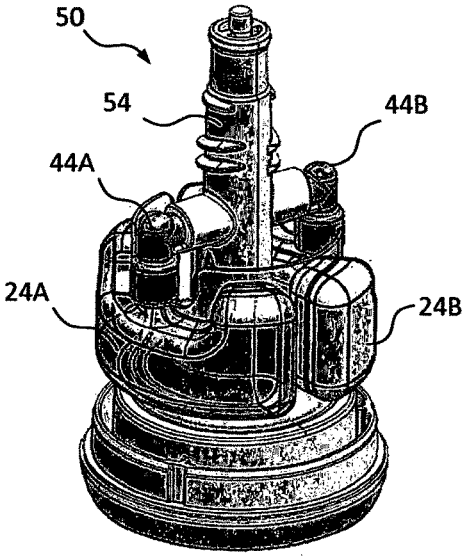

In FIG. 12G a perspective view is shown of the connection part 50 with the reservoir outlets of the reservoirs 24A, 24B inserted in the additive liquid communication tubes 44A, 44B for connection to the passage part 54.

In use, it is an advantage of this invention that the liquid container 11 and the closure arrangement 20 can be stored and transported to the end user separately. The base liquid 16 could be an unflavoured liquid which is inherently stable, and has a long shelf life. The base liquid 16 could be an aqueous base liquid, such as water, a mineral water or carbonated water. In another example, the base liquid 16 could be an alcohol base liquid, and could include beer, cider, vodka, gin, whisky, rum, schnapps or similar. In yet another example, the base liquid 16 could be an oil based liquid. The base liquid could be a cosmetic, such as a shampoo, and the additive for example a particular fragrance.

In one example, the closure arrangement 20 includes a first additive liquid 24A which is a flavouring concentrate and a second additive liquid 24B which is phosphoric acid (which acts as a flavour enhancer and preservative).

A plurality of closure arrangements 20 could be provided, each with different additive liquids 28. For example, the closure arrangements 20 could provide different flavouring concentrates, which might require different flavour enhancers/preservatives/stabilisers.

Thus, the user could select a desired combination of base liquid and flavouring concentrate by selecting the appropriate liquid container 11 and the appropriate closure arrangement 20. The selection of the liquid container 11 and the closure arrangement 20 could be, for example, at a point of sale such as a retail outlet or bar, or alternatively after purchase at the user's home, workplace or other suitable location. The invention could be particularly advantageous in locations where space is at a premium, such as in vehicles such as cars, trains or aircraft.

Following selection, the closure arrangement 20 is mounted to the liquid container 11 to form the liquid container assembly 10 as shown in FIGS. 1 and 2 by screwing the closure arrangement 20 onto the liquid container 11, the threaded formation of the liquid container 11 co-operatively engaging the threaded part 52 of the connection part 50 of the closure arrangement 20.

FIGS. 3A to 3E and corresponding FIGS. 4A to 4E show the closure arrangement 20 in use. In these Figures, arrow A indicates the suction force applied by the user; arrow B, the flow of the base liquid 16; arrow X, the flow of the additive liquid 28A; arrow Y, the flow of the additive liquid 28Y; and arrow Z, the mixed additive and base liquid flow.

Figure 4B:
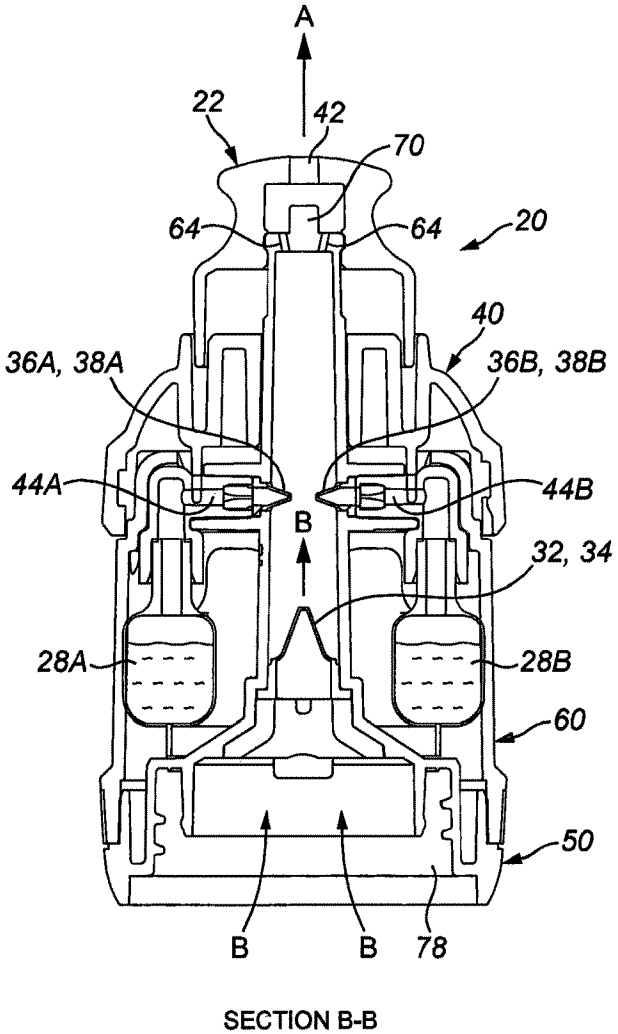
Figure 4A:
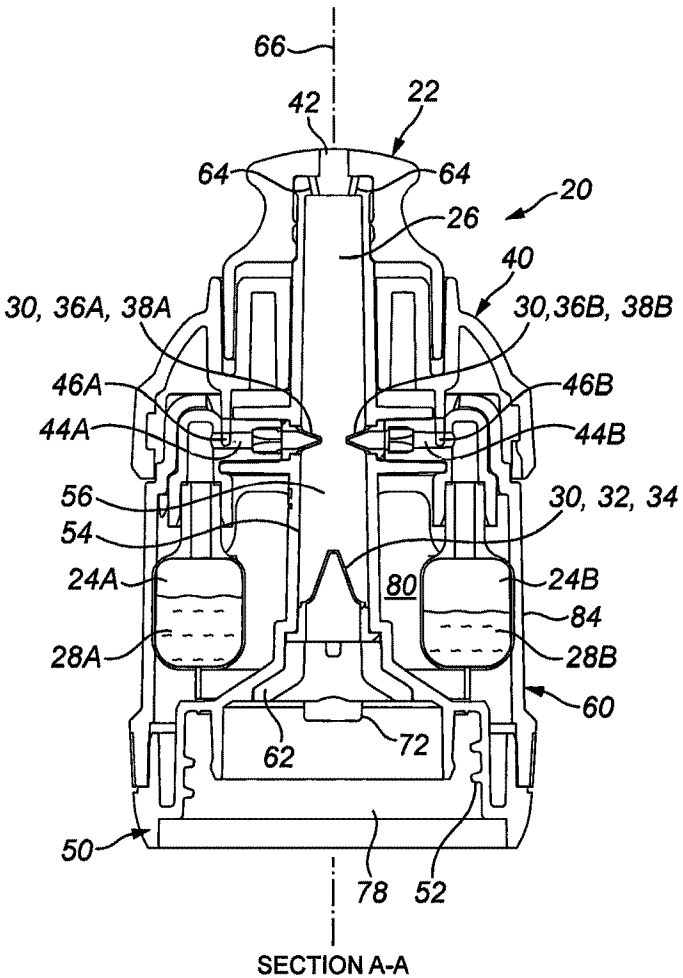

In FIG. 3A and FIG. 4A, the closure arrangement valve 22 is in the closed condition and the adjuster 40 is in the no flow condition, with the adjuster marking 68A aligned with the third body part marking 68D. No liquid flows through the closure arrangement valve passage 24, and no liquid flows along the additive liquid communication tubes 44A, 44B to the additive liquid regulators 36A, 36B.

In FIG. 3B and FIG. 4B, the closure arrangement valve 22 has been moved to the open condition, but the adjuster 40 is still in the no flow condition. If a suction force (such as that provided by a user sucking the closure arrangement valve 22) is applied to the closure arrangement valve passage 42 (as indicated by arrow A in FIG. 4B) in combination with the liquid container assembly 10 being tilted upward so that the base liquid 16 runs downwardly into the closure arrangement 20, the base liquid 16 will flow through the base liquid regulator 32, along the body passage 56, through the outlet passages 64 and through the closure arrangement valve passage 42. The base liquid 16 will be unflavoured in this condition, as the adjuster 40 is in the no flow condition and there is no flow of the additive liquids 28 along the additive liquid communication tubes 44 to the additive liquid regulators 36.

Figure 4D:
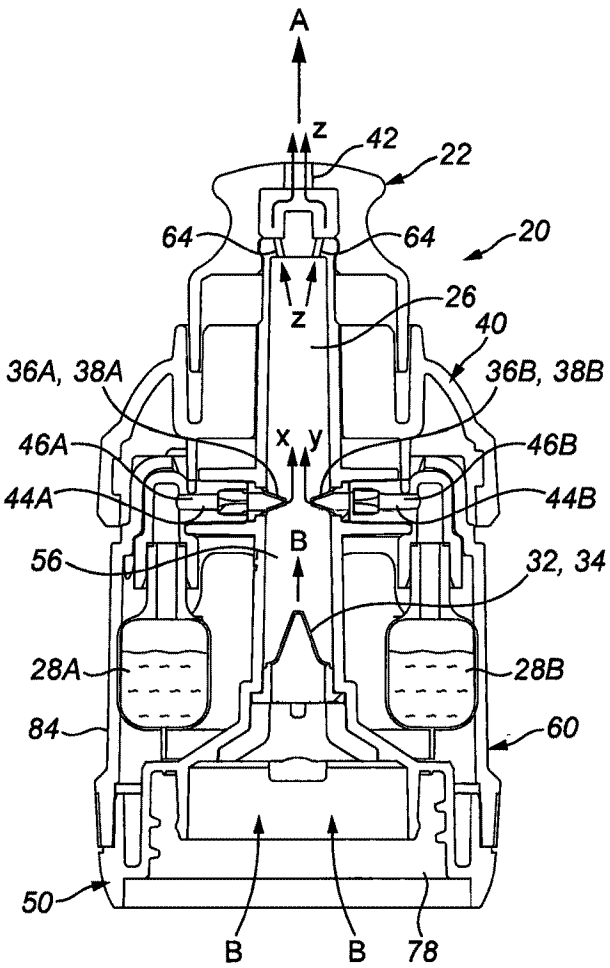
Figure 4C:
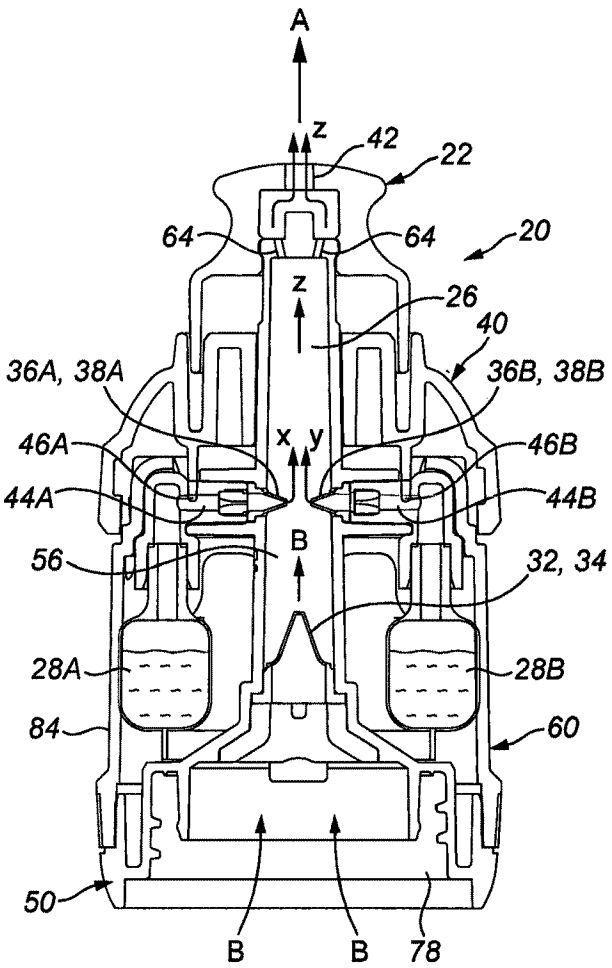

In FIG. 3C and FIG. 4C, the closure arrangement valve 22 is again in the open condition as in FIGS. 3B and 4B. Relative to the FIGS. 3B and 4B, the adjuster 40 has been rotated so that the adjuster marking 68A is aligned with the first body part marking 68B. As described above, in this position, the adjuster 40 is in the low flow condition in which the adjuster gate formation 46 have moved somewhat off the tubes 44 so that the tubes 44 are less deformed and thus permit a relatively small flow of the additive liquids 28 along the additive liquid communication tubes 44 to the additive liquid regulators 36.

Further rotational movement of the adjuster 40 towards the second body part marking 68C will permit increasing flow of the additive liquids 28A, 28B. In FIGS. 3D and 4D, the adjuster 40 has been rotated to the full flow condition indicated by the alignment of the second body part marking 68C and the adjuster marking 68A. In this condition, the adjuster gate formation 46 has moved so that the tubes 44 permit full flow of the additive liquids 28 along the tubes 44.

In both the low flow and full flow conditions as shown in FIGS. 3C, 4C and FIGS. 3D, 4D respectively, the liquid container assembly 10 is operated as follows.

The liquid container assembly 10 is tilted upwards so that the base liquid 16 runs towards and into the inlet space 78. The user applies a suction force as indicated by arrow A in FIGS. 3C, 4C and FIGS. 3D, 4D. The suction force draws the base liquid 16 through the base liquid valve 34 into the body passage 56 and then towards and through the outlet passages 64 and the closure arrangement valve passage 42. At the same time, the suction force draws the additive liquids 28 through the additive liquid valves 38 into the mixing space 26 to mix with the base liquid 16 and thence towards and through the outlet passages 64 and the closure arrangement valve passage 42. The closure arrangement valve passage 42 is not in flow alignment with the outlet passages 64, which further promotes mixing of the base liquid 16 and the additive liquids 28A, 28B. Thus, advantageously, the additive liquids 28 are mixed with each other and the base liquid 16 within the closure arrangement 20 before entering the user's mouth.

As the base liquid 16 moves out of the interior 12, the pressure in the interior 12 reduces. The one way relief valve 72 permits air to move from the body space 80 to the inlet space 78 to equalize the pressure, so that the flow of base liquid 16 from the interior 12 is not reduced. The one way relief valve 72 does not permit passage of the base liquid 16 from the inlet space 78 to the body space 80. The relief valve 72 permits pressure equalization while the user is drinking, so that the user can drink continuously.

Each reservoir 24 is formed of a flexible material and is relatively thin walled, so that as the additive liquid 28 is drawn from the reservoir 24, the reservoir 24 collapses. The flexible, thin walled, collapsible reservoirs 24 do not require pressure equalization. As the additive liquid 28 exits from the reservoir 24, the reservoir 24 can collapse and adapt in volume such that there is no build-up of a vacuum in the reservoir 24. Pressure equalisation can ensure that, for a given user suction level, the amount of additive liquid 28 that is drawn out from the reservoir 24 does not vary throughout the life of the closure arrangement 20 but occurs at a more-or-less constant level throughout its life.

By virtue of the casing 84 being relatively stiff and tough the collapsible reservoir 28 is protected for convenient handling and for example the user is prevented from inadvertently squeezing additive liquid 28 out of the reservoir 24. In this arrangement because the additive liquid 28 is contained in (and sealed in) the reservoir 24 the casing 84 does not need to be airtight and the body space 80 defined by the casing 84 can be in fluid communication with the environment. As the casing does not need to be sealed against the environment advantages are provided regarding ease of fabrication of the closure arrangement. Further, as the additive liquid 28 exits from the reservoir 24, air can enter the body space 80 and the reservoir 24 can collapse, so there is no build-up of a vacuum in the casing 84 or in the reservoir 24. Also, as the base liquid 16 exits from the liquid container 11, air can enter the liquid container 11 from the body space 80 through the one way relief valve 72 in the passage 76. This can prevent a vacuum from forming in the liquid container 11. This is particularly important where the base liquid valve 34 inhibits or prevents backflow that could equalise a pressure difference between the environment and the interior of the liquid container 11. Together these features can enable approximately constant performance of the closure arrangement 20 throughout its life.

The same suction force causes flow of both the base liquid 16 and the additive liquids 28, a higher suction force causing greater flows of both the base liquid 16 and the additive liquids 28, and a lower suction force likewise causing lower respective flows. Thus, the common suction force provides a linkage or association between the flows of the base liquid 16 and the additive liquids 28 so that relative flow ratios or proportions are maintained over a range of flow rates. The association or linkage is direct, so that the flows increase or reduce together.

The relative proportions or ratios of the additive liquids 28 to each other are determined by: the flow properties of the additive liquids 28; the relative sizes of the tubes 44; the relative sizes and/or operating characteristics of the additive regulators 36; and the operation of the adjuster 40 and the adjuster gate formation 46.

In the example shown, the additive liquids 28 have: similar flow properties, the same tubes 44 and additive regulators 36, and the adjuster gate formation 46 is arranged to operate in substantially the same way for each additive liquid 28 as the adjuster 40 is rotated. This ensures that a constant addition ratio is maintained between the additive liquids 28. In one example, the additive liquid addition ratio is substantially 1:1 by volume.

Similarly, the relative proportion or ratio of the additive liquids 28 to the base liquid 16 is determined by the factors given above (ie the flow properties of the additive liquids 28; the relative sizes of the tubes 44; the relative sizes and/or operating characteristics of the additive regulators 36; and the operation of the adjuster 40 and the adjuster gate formation 46) and: the flow properties of the base liquid 16; and the relative size and/or the operating characteristics of the base liquid regulator 32.

By careful understanding and control of the above factors, the closure arrangement 20 can be arranged to provide precise and repeatable relative flow rates of the additive liquids 28 and the base liquid 16. Thus the relative volumes of the additive liquids to each other and to the base liquid can be predetermined by careful design and control of the above factors.

Generally, the proportion or ratio by volume of the total additive liquids 28 to the base liquid 16 is very small, and in one example could be in the range 1:50 to 1:500, more desirably in the range 1:200 to 1:375 and optimally in the range 1:275 to 1:300.

In one example, the first additive liquid 28A is a flavouring concentrate, the second additive liquid 28B is phosphoric acid, the ratio of the first and second additive liquids 28A, 28B to each other is substantially 1:1, the base liquid 16 is water and the addition rate is 0.035 ml total additive liquids 28 to 10 ml base liquid 16.

One advantage of the arrangement described is that the addition of the additive liquids 28 only takes place when the user applies suction to the closure arrangement valve passage 42. For example, if the closure arrangement 20 is in the open condition and the liquid container 11 is simply squeezed and/or upended, the base liquid 16 could be forced through the base liquid valve 34 and leak out of the closure arrangement valve passage. However, the additive liquid reservoirs 24, although compressible, are protected by the relatively stiff, tough casing 84 comprising the body part 60 and are remote from and not subject to the same squeezing force as the liquid container 11 or the weight of the base liquid 16 in the interior 12, and thus the additive liquids 28 do not substantially leak under these circumstances. Waste of the expensive ingredients is thus reduced or prevented.

Figure 4E:
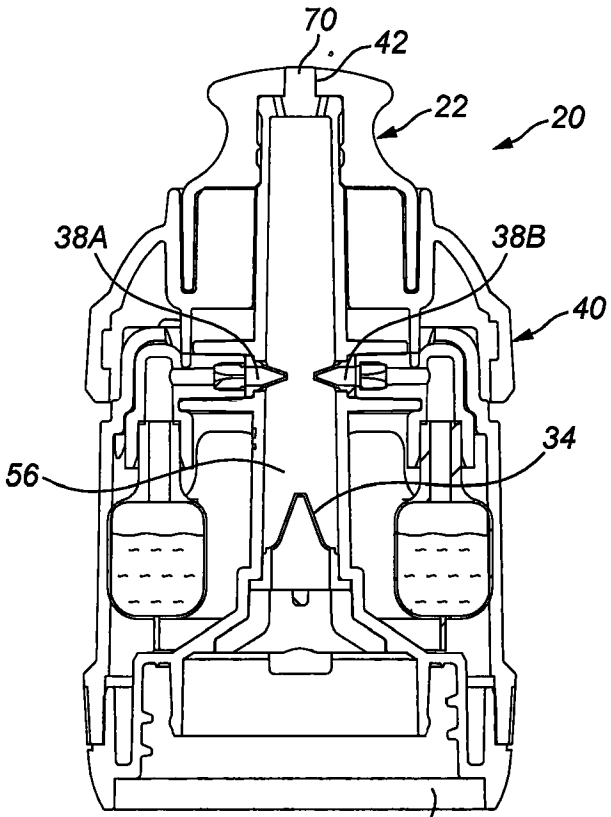
Figure 5B:
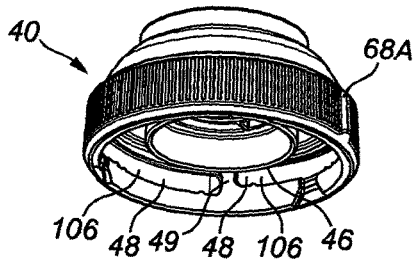
Figure 5C:
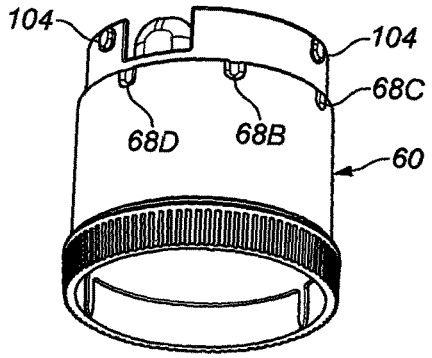
Figure 5D:
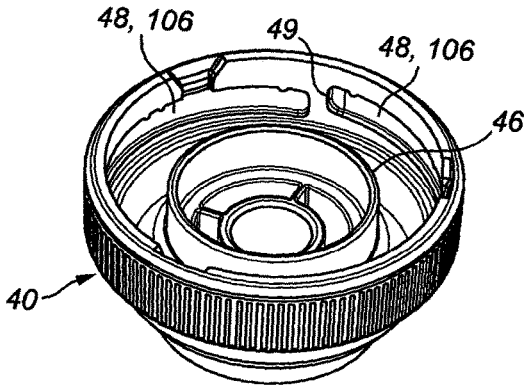
Figure 5E:
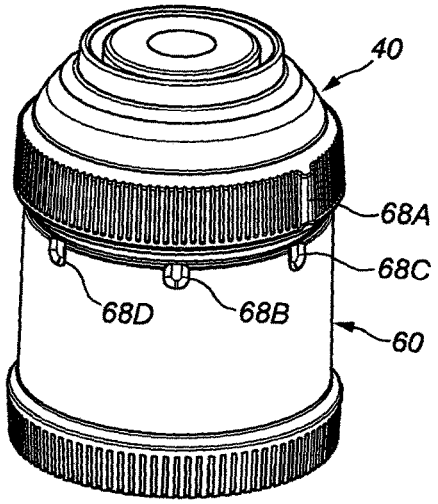

In FIGS. 3E and 4E, the adjuster 40 is still in the full flow condition, but the closure arrangement valve 22 is now in the closed condition, preventing a suction force being applied by the user to the closure arrangement valve passage 42, and thereby preventing further flow of the base liquid 16 and the additive liquids 28. The one way base liquid valve 34 and the one way additive liquid valves 38 prevent back flow of any liquid in the body passage 56 from entering the tubes 44 or flowing back into the interior 12.

There is thus provided a closure arrangement 20 for a liquid container 11 which permits the accurate addition of relatively small amounts of additive liquids to a base liquid at the point of use. The closure arrangement 20 provides premixing of the additive liquids with the base liquid within the closure arrangement 20 before the liquids enter the user's mouth, so that the user's experience is similar to that which would have been experienced with a conventional drinks bottle containing a drink manufactured at a remote factory location. Advantageously, as the premixing occurs just before drinking, the amount of preservatives, stabilisers and other additives in the drink can be reduced, improving the user's experience, reducing the user's concerns with regard to the use of additives and reducing ingredient cost.

A further advantage is that the closure arrangement 20 permits the user to adjust the addition rate of the additive liquid(s) to taste.

As there is no back flow of liquid from the closure arrangement 20 into the interior 12 of the container 11, the closure arrangement 20 can be removed and replaced by another closure arrangement 20 with a different flavouring. Likewise, the closure arrangement 20 can be removed and re-used with a different container 11. Thus, the reservoirs 24 could be sized to contain sufficient additive liquids for addition to a plurality of containers 11 of base liquid 16. The closure arrangement 20 could be mounted successively to a plurality of containers 11 which could contain different base liquids, for example, still water and sparkling water.

In one example, each reservoir 24 can hold 5 ml of additive liquid, sufficient for addition to approximately 4 litres of base liquid.

The connection part 50 could be arranged to connect to standard sized drinks containers or bottles, allowing the closure arrangement 20 of the invention to be used with conventional containers or bottles. In another embodiment, an adapter (not shown) could be provided to connect the closure arrangement 20 to drinks bottles and liquid containers having different sized openings 14.

In an example, the closure arrangement 20 is disposable, and once the reservoirs 24 are empty the cap closure is replaced. In an example the flexible, thin walled, collapsible reservoirs 24 are sealed within the relatively stiff and tough casing 84 to protect against tampering. In an alternative, the relatively stiff and tough casing 84 can be opened by the user to exchange the collapsible reservoirs 24. In this case the collapsible reservoirs 24 may be supplied suitably sealed, and the closure arrangement 20 may include a means of opening such a seal.

In an alternative, there are a number of reservoirs 24 (such as two or three) with each reservoirs 24 being individually adjustable by an adjuster 40 and adjuster gate formation 46. For each reservoir 24 an adjuster 40 is arranged to permit a user to adjust the amount of one of the additive liquids 28 individually. Thus the user can select the strength of each of a number of different flavourings individually (e.g. raspberry flavour, apple flavour, no flavour, or raspberry and apple flavour combined).

FIGS. 14A to 14C illustrate an example of a closure arrangement 20 that is adapted for four different reservoirs 24 each with its own adjuster 40. Each reservoir 24 is attached to an adjuster 40 that can open or close the connection between the reservoir 24 and an additive liquid communication tube 44 that leads to the mixing space 26. As shown in more detail in FIGS. 14B (showing the adjuster 40 in an open configuration) and 14C (showing the adjuster 40 in an closed configuration), the adjuster comprises a gate formation 140 in the form of a rotatable part that in one position connects the reservoir 24 to the additive liquid communication tube 44, and in another configuration blocks the connection between the reservoir 24 and the additive liquid communication tube 44. By rotation of the gate formation 140 the user can select if the reservoir is connected to, partially connected to, or fully blocked from the mixing space.

As described above the closure arrangement 20 includes a regulator arrangement 30 that includes a base liquid regulator in the form of a one way base liquid valve 34 which inhibits or prevents back flow of liquid into the liquid container 11. For each of the four additive reservoirs there is included an additive liquid regulator in the form of a one way additive liquid valve 38 arranged so as to inhibit or prevent back flow of liquid from the mixing space 26 into the respective reservoir 24. The additive liquid valves 38 are shown arranged within the additive liquid communication tubes 44, but may alternatively be arranged such that their outlets project into the body passage defined by the passage part 54.

In the closure arrangement 20 illustrated in FIGS. 14A to 14C different flavours maybe accessed through a number of duckbill valves 38 and their respective separate reservoirs 24 in order that the user can choose the flavour(s) and/or additive(s) he or she wishes to drink by fully or partially opening or closing off one or more of the adjusters 40. By each reservoir 24 having its own mechanism for allowing either a full, no, or controlled flow of additive liquid a single flavour may be selected for addition to the base liquid, or multiple flavours at different, user-selected ratios may be added to the base liquid. This can provide greater freedom in user selection of the flavouring and thus provide a more enjoyable and individual drinking experience for the user.

In an alternative, an indicator is provided to indicate the amount of additive fluid 28 remaining in the reservoir 24. To enable indication, the casing 84 and the reservoir 24 can for example be transparent or partially transparent.

FIGS. 13A and 13B illustrate an example of a liquid container assembly 10 including a liquid container 11 and a closure arrangement 20 with the casing 84 transparent such that the reservoir 24 is visible. In the illustrated example the reservoir 24 is opaque, and the amount of additive fluid 28 remaining in the reservoir 24 is indicated by the state of collapse of the collapsible sack-like reservoir 24. Alternatively the reservoir 24 itself may be transparent so that the amount of additive fluid 28 remaining in the reservoir 24 is visible and is thus indicated.

In an alternative, an indicator is provided to indicate the number of times the closure arrangement 20 has been fitted to a liquid container 11. This can provide an indication of the past use of the closure arrangement. For example a ratchet mechanism may be incremented each time the closure arrangement 20 is fitted to a liquid container 11.

In an alternative, an indicator is provided to indicate the amount of base liquid that has passed through the closure arrangement 20. This can provide an indication of the past use of the closure arrangement 20.

In an alternative, the liquid container 11 is collapsible and as the base liquid 16 exits from the liquid container 11 the liquid container 11 collapses, so there is no build-up of a vacuum in the liquid container 11. In this case the one way relief valve 72 in the passage 76 is not necessary and can be omitted as it is not required to prevent a vacuum from forming in the liquid container 11.

In an alternative, the additive liquid 28 is not drawn out of the additive liquid communication tubes 44 by user suction, but by the Venturi effect. In this case there is a constriction of the passage 54 carrying the base liquid 16 at the outlet of the additive liquid communication tubes 44. When the base liquid 16 passes through the constriction, the additive liquid 28 is drawn out, regardless of whether the bass liquid 16 is being forced through the passage 54 by user suction, by the user squeezing the liquid container 11, or by the user turning the container 11 so that gravity forces the liquid 16 through the passage 54. The Venturi effect may be strong enough to open the additive liquid regulators 36. In order to enable user regulation of the amount of additive liquid 28 added to the base liquid 16 in the mixing space 26, the constriction may be user adjustable, which would adjust the strength of the Venturi effect and thus of the amount of additive liquid 28 drawn out.

FIGS. 6 to 11 show other embodiments of the invention, many features of which are similar to those already described in relation to the embodiment of FIGS. 1 to 5. Therefore, for the sake of brevity, the following embodiments will only be described in so far as they differ from the embodiment already described. Where features are the same or similar, the same reference numerals have been used and the features will not be described again.

FIGS. 6 and 7 show a second liquid container assembly 210 including a liquid container 11 and a closure arrangement 220. In this embodiment, the closure arrangement 220 includes only one liquid additive reservoir 24. The closure arrangement 220 includes a connection part 50 including a passage part 54 defining a body passage 56, a body part 60 and a closure arrangement valve 22, but no adjuster.

The closure arrangement 220 defines a mixing space 26 in which in use the additive liquid 28 is added to the base liquid 16 and which is located upstream of the valve 22. The closure arrangement 220 includes a regulator arrangement 30 which regulates the relative volumes of the additive liquid 28 and the base liquid 16 to the mixing space 26.

In this embodiment, the regulator arrangement 30 includes a turbine 86, which includes a plurality of vanes 88 mounted to an axle 90 mounted for rotation to the connection part 50.

Over a portion of the circumference of rotation of the tips of the vanes 88, the vanes 88 contact and deform the additive communication tube 44. The inlet space 78 directs the flow of base liquid 16 towards the underside of the vanes 88 which are on the side of the axle 90 towards the tube 44.

In use, with the closure arrangement valve 22 in the open condition, when a user applies a suction force to the closure arrangement valve passage 42, the base liquid 16 is drawn through the inlet space 78, causing the turbine 86 to rotate as indicated by arrow E in FIG. 7B. The tips of the vanes 88 contacting and moving along the tube 44 provide a peristaltic effect, causing a flow of the additive liquid 28 to the mixing space 26.

In FIGS. 6A, 6B, 7A and 7B, the closure arrangement valve 22 is in the closed condition. It will be understood that the arrows shown in FIG. 7B represent the liquid flows in use with the closure arrangement valve 22 in the open condition. Arrow A indicates the suction force applied by the user; arrow B, the base liquid flow; arrow X, the additive liquid flow; arrow Z the mixed additive and base liquid flow.

It should be noted that this embodiment does not necessarily depend on suction force to turn the turbine 86. The turbine 86 could be turned by base liquid 16 being forced therethrough by the user squeezing the liquid container 11, or turning the container 11 so that gravity forces the liquid 16 therethrough.

The arrangement of this embodiment provides the advantage that the flows of the base liquid 16 and the additive liquid 28 are mechanically linked, in that they are both determined by rotation of the turbine 86. As rotation of the turbine 86 varies due to variations in the flow rate of the base liquid 16 so the flow rate of the additive liquid 28 will vary correspondingly. Thus, the flows of the additive liquid and the base liquid are associated or linked, and the association or linkage is direct, as the flows increase or reduce together.

In the example illustrated in FIGS. 6 and 7 no adjuster is provided for regulating the amount of additive liquid added to the base liquid in the mixing space. In an alternative, an adjuster gate formation is included that moves relative to the additive liquid communication tube 44 to selectively deform the tube 44 to permit substantially no additive liquid flow in a no flow condition and a full additive liquid flow in a full flow condition.

FIGS. 8 and 9 show a third liquid container assembly 310 including a liquid container 11 and a closure arrangement 320. This embodiment is similar to the previous in that the closure arrangement 320 includes only one liquid additive reservoir 24. The reservoir 24 is fixed to the body part 60. The closure arrangement 320 includes a connection part 50 including a passage part 54 defining a body passage 56, a body part 60 and a closure arrangement valve 22, but no adjuster.

The closure arrangement 320 defines a mixing space 26 in which in use the additive liquid 28 is added to the base liquid 16 and which is located upstream of the valve 22. The closure arrangement 320 includes a regulator arrangement 30 which regulates the flows of the additive liquid 28 and the base liquid 16 to the mixing space 26.

In this embodiment, the regulator arrangement 30 includes a turbine 86, which includes a plurality of vanes 88. In this embodiment, the turbine 86 is rotatably mounted to a turbine support 92 which is fixed to the passage part 54. The turbine 86 includes a threaded pin 94, to which is rotatably mounted a piston 96, which includes threaded formations (not shown) which cooperate with the threaded pin 94.

In use, with the closure arrangement valve 22 in the open condition, when a user applies a suction force to the closure arrangement valve passage 42, the base liquid 16 is drawn through the inlet space 78, causing the turbine 86 to rotate around the central axis 66 and the reservoir 24. As the turbine 86 rotates, the threaded pin 94 drives the piston 96 towards the closure arrangement valve passage 42, causing a flow of the additive liquid 28 through the tube 44 to the mixing space 26.

The piston 96 moves within the reservoir 24 so as to change the volume of the reservoir 24, and in effect collapse the reservoir volume as the additive liquid 28 exits the reservoir 24. In this sense the piston 96 ensures that the reservoir 24 has the feature of collapsibility in this embodiment.

As previously, arrow A indicates the suction force applied by the user; arrow B, the base liquid flow; arrow X, the additive liquid flow; arrow Z the mixed additive and base liquid flow.

As with the previous embodiment, this embodiment does not necessarily depend on suction force to turn the turbine 86. The turbine 86 could be turned by base liquid 16 being forced therethrough by the user squeezing the liquid container 11, or turning the container 11 so that gravity forces the liquid 16 therethrough.

As with the previous embodiment, the flow of the base liquid 16 and the additive liquid 28 are mechanically linked, in that they are both determined by rotation of the turbine 86. As rotation of the turbine 86 varies (due to variations in the suction force applied by the user) so the flow rate of both the base liquid 16 and the additive liquid 28 will vary correspondingly. Thus, the flows of the additive liquid and the base liquid are associated or linked, and the association or linkage is direct, as the flows increase or reduce together.

In order to ensure the appropriate amount of additive liquid 28 exits the reservoir 24, the number of vanes 88 on the turbine 86 and the flow cross section in the turbine portion of the body passage 56 may be selected as appropriate.

In the example illustrated in FIGS. 8 and 9 no adjuster is provided for regulating the amount of additive liquid added to the base liquid in the mixing space. In an alternative, a constriction the flow cross section in the turbine portion of the body passage may be user adjustable, which would adjust the flow speed in the turbine portion and thus of the amount of additive liquid drawn out.

FIGS. 10 and 11 show a fourth liquid container assembly 410 including a liquid container 11 and a closure arrangement 420. This embodiment is similar to the previous in that the closure arrangement 420 includes only one liquid additive reservoir 24. The closure arrangement 420 includes a connection part 50 including a passage part 54 defining a body passage 56, an adjuster 40, a body part 60 and a closure arrangement valve 22.

The closure arrangement 420 defines a mixing space 26 in which in use the additive liquid 28 is added to the base liquid 16 and which is located upstream of the valve 22. The closure arrangement 420 includes a regulator arrangement 30 which regulates the flows of the additive liquid 28 and the base liquid 16 to the mixing space 26.

In this embodiment, the reservoir 24 is in the form of a syringe with a plunger 98. The plunger 98 moves within the syringe so as to change the volume of the syringe, and in effect collapses the reservoir volume as the additive liquid 28 exits the reservoir 24. In this sense the plunger 98 ensures that the reservoir 24 has the feature of collapsibility in this embodiment. The regulator arrangement 30 includes a base liquid regulator 32 which includes a one way base liquid valve 34 which inhibits or prevents back flow of the base liquid 16 into the interior 12. In this embodiment, the base liquid valve 34 is a duckbill valve and could be formed of a resiliently deformable material, such as TPE.

The regulator arrangement 30 includes an additive liquid regulator 36 which includes a one way additive liquid valve 38 which inhibits or prevents back flow of the additive liquid 28 into the reservoir 24. In this embodiment, the additive liquid valve 38 is a duckbill valve and could be formed of a resiliently deformable material, such as TPE.

In this embodiment, the adjuster 40 defines an adjuster aperture 102 which is offset from the central axis 66. The connection part 50 includes a tube part 44 which communicates the additive liquid 28 from the reservoir 24 to the mixing space 26. The tube part 44 defines an aperture 100 which is also offset from the central axis 66. The adjuster 40 is rotatable around the central axis 66 between a no flow condition in which the tube aperture 100 is not aligned with the adjuster aperture 102 and therefore flow therethrough is prevented and a full flow condition in which the adjuster aperture 102 is aligned with the tube aperture 100, and flow therethrough is permitted. The apertures 100, 102 may also be such that in an intermediate position the apertures 100, 102 are partially aligned and a partial flow therethrough is permitted. The adjuster 40 includes a marking 68A in the form of a projection.

In use, with the closure arrangement valve 22 in the open condition and the adjuster 40 in at least a minimal flow condition, when a user applies a suction force to the closure arrangement valve passage 42, the base liquid 16 is drawn through the inlet space 78, through the base liquid valve 34 into the body passage 56 and then towards the mixing space 26. At the same time, the suction force draws the additive liquid 28 through the additive liquid valve 38, through the tube aperture 100 and the adjuster aperture 102 into the mixing space 26 to mix with the base liquid 16 and thence towards and through the closure arrangement valve passage 42. The plunger 98 is such that it can seal the reservoir, and at the same time it can move within the syringe. In the example shown in FIG. 10B an additional syringe end cap is provided, however this is not a sealing end cap, as otherwise a vacuum would build up as the plunger 98 moves in the syringe.

As with the first embodiment, in this embodiment, the common suction force provides a linkage or association between the flows of the base liquid 16 and the additive liquids 28 so that relative flow ratios or proportions are maintained over a range of flow rates. The association or linkage is direct, so that the flows increase or reduce together.

As previously, arrow A indicates the suction force applied by the user; arrow B, the base liquid flow; arrow X, the additive liquid flow; arrow Z the mixed additive and base liquid flow.

In a variant to this embodiment, the adjuster 40 could define a plurality of differently sized adjuster apertures 102, and the tube part 44 could also define a plurality of differently sized apertures 100 so that different alignments could provide different ratios of additive liquid to base liquid.

In the example illustrated in FIGS. 10 and 11 a base liquid regulator 32 which includes a one way base liquid valve 34 and an additive liquid regulator 36 which includes a one way additive liquid valve 38 are provided. This can provide the same advantages as described with reference to FIGS. 3 and 4, and in particular can prevent backflow of the fluids and thus cross-contamination.

In another alternative, the syringe is detachable from the connection part 50 so that the user can exchange flavouring reservoirs, or replace empty reservoirs. This would enable implementation of a more lasting connection part 50 not necessarily intended for disposal. In this case the reservoirs may be supplied suitably sealed, such as by a sealing film, and the closure arrangement may include a means of opening such a seal, such as a bayonet fitting with a suitable protrusion.

FIGS. 15A to 15D show a fifth liquid container assembly 510 including a liquid container 11 and a closure arrangement 520. Instead of the syringe with the plunger a flexible as described with reference to FIGS. 10 and 11, a thin walled, collapsible reservoir 24 is provided. In an example the reservoir 24 is a bag filled with flavouring.

To enable convenient handling, and in particular for a detachable (removable) additive capsule 512, the collapsible reservoir 24 is housed within a relatively stiff and tough casing 506. The casing 506 is not sealed against the environment, but allows fluid communication through an aperture 514 defined in the casing 506 to enable pressure equalisation as the collapsible reservoir 24 changes in volume so that no vacuum builds up as the reservoir 24 empties. The additive liquid 28 is drawn out of the reservoir 24 and into the mixing space for mixing with the base liquid 16 by user suction same as described with reference to FIGS. 1 to 5 and 12. The casing 506 may include a one way relief valve to avoid uncontrolled exchange with the environment through the aperture 514.

In the example illustrated in FIGS. 15A to 15D the additive capsule 512 with the reservoir 24 is detachable from the closure arrangement 520 so that the user can exchange flavouring reservoirs, or replace empty reservoirs. This can enable implementation of a more lasting closure arrangement 520 not necessarily intended for disposal.

In the illustrated example the additive capsule 512 is connected to the closure arrangement 520 by threaded fitting parts 504, 503 on the capsule 512 and the closure arrangement 520 that correspond to one another. The connection effected by the fitting parts 504, 503 is sealed such that no leakage occurs. This allows the user to screw an additive capsule 512 into the closure arrangement 520 for connecting the reservoir 24 to the closure arrangement 520. Once an additive capsule 512 has been connected to the closure arrangement 520, the closure arrangement 520 operates in the same way as the closure arrangement 420 described above with reference to FIGS. 10 and 11.

To ensure the additive capsule 512 is not tampered with prior to use, and for ease of transport, a sealing film 508 such as a foil seal seals the reservoir 24 within the additive capsule 512. The closure arrangement 20 includes a means of opening such a sealing film 508 in the form of a needle 502 that can punch through the sealing film 508. The sealing film 508 is arranged at the fitting portion 503 of the additive capsule 512 that is threaded into the fitting 504. In this arrangement the needle 502 projects into the reservoir 24 once the additive capsule 512 is connected and the needle 502 then provides a fluid outlet from the reservoir 24.

As described above, a one way base liquid valve 34 and a one way additive liquid valve 38 are provided that can prevent backflow of the fluids and thus cross-contamination. The adjuster 40 defines an adjuster aperture 102 which is offset from the central axis. The connection part 50 includes a tube part 44 which communicates the additive liquid 28 from the reservoir 24 to the mixing space 26. The tube part 44 defines an aperture 100 which is also offset from the central axis. The adjuster 40 is rotatable around the central axis between a no flow condition in which the tube aperture 100 is not aligned with the adjuster aperture 102 and therefore flow therethrough is prevented and a full flow condition in which the adjuster aperture 102 is aligned with the tube aperture 100, and flow therethrough is permitted. In an intermediate position the apertures 100, 102 are partially aligned and a partial flow therethrough is permitted. This can enable user control and selection of the flavouring level.

In an alternative the aperture 514 is arranged such that it is not within the interior of the base liquid container in use, as is shown in the example illustrated in FIGS. 15A to 15D, but instead at the top 503 of the capsule 512 for exchange and pressure equalisation with the body space 80. Provided the casing 84 is such that air exchange between the casing body space 80 and the atmosphere can occur, air movement from the body space 80 to the (otherwise sealed) capsule casing 506 can be permitted, same as the closure arrangement 20 described with reference to FIGS. 1 to 5 and 12.

Various other modifications could be made without departing from the scope of the invention. The various components of the invention could be of any suitable size and shape, formed by any suitable process and could be formed from any suitable material. The base and additive liquid valves could be of any suitable design. The proportions or ratios of the additive liquids to each other and to the base liquid could be different. The number of additive liquids could be different, and could vary from one to any suitable number as required.

The closure arrangements of the invention could be provided to fit to any bottle, with any form of opening of any size.

The closure arrangements of the invention could be in the form of a cap or a bottle topper.

The closure arrangements of the invention could be used with different liquids, where it could be advantageous to mix relatively small amounts of additive(s) with a base liquid at the point of use. For example, the closure arrangements could be used with pharmaceuticals and medicines, health related drinks or energy drinks.

In another embodiment, the liquid container could be refillable by the user. The base liquid could be tap water.

The closure arrangement could include mixing formations (not shown) in the mixing space to promote mixing of the additive liquid(s) and the base liquid. For example, the mixing formations could include threaded formations on the interior walls of the passage part 54, the outlet passages 64 and/or the valve passage 42. The threaded formations could include vanes, fins, or rifling. The outlet passages 64 described above are arranged such that they provide an obstacle to the flow path, and thus introduce turbulences and promote mixing. The outlet passages 64 can additionally be shaped to promote a helical flow path and thus promote mixing.

Any of the features or steps of any of the embodiments shown or described could be combined in any suitable way, within the scope of the overall disclosure of this document.

The invention thus provides closure arrangements for liquid containers which permit the accurate addition of relatively small amounts of an additive liquid or liquids to a base liquid at the point of use. Each closure arrangement provides premixing of the additive liquid(s) with the base liquid within the closure arrangement before the liquids enter the user's mouth. The user is required to provide a suction force to cause flow of the base and additive liquids. Each closure arrangement could be reused with a plurality of liquid containers. Advantageously, utilising the invention reduces the volume of finished product stock. Production, transportation and stock holding is more flexible. New flavourings can be introduced more easily. As the liquids are mixed at the point of use, the use of stabilisers and preservatives can be reduced.

It will be understood that the present invention has been described above purely by way of example, and modifications of detail can be made within the scope of the invention.

Each feature disclosed in the description, and (where appropriate) the claims and drawings may be provided independently or in any appropriate combination.

Reference numerals appearing in the claims are by way of illustration only and shall have no limiting effect on the scope of the claims.

The invention claimed is:

1. A closure arrangement for a liquid container for a base liquid, the closure arrangement comprising:

a reservoir for an additive liquid; and a passage for flow of liquid from the liquid container to a user, the passage including an inlet and an outlet and a mixing space therebetween for receiving the additive liquid from the reservoir and the base liquid, wherein the reservoir is in fluid communication with, and has a junction with, the mixing space at a position between the inlet and the outlet of the passage;

wherein the reservoir is collapsible; and wherein a volume of the reservoir decreases as a result of the additive liquid flowing therefrom due to a suction force caused by a user-induced flow through the passage.

2. The arrangement according to claim 1, in which the reservoir is adapted such that it is collapsible under the influence of the user.

3. The arrangement according to claim 1, in which the reservoir is such that the reservoir volume decreases as additive liquid flows out of the reservoir.

4. The arrangement according to claim 1, in which the reservoir is formed at least partially of a flexible material, a thin walled material, a resiliently deformable material, a non-resiliently deformable material, a bag and/or a pouch.

5. The arrangement according to claim 1, further comprising a casing arranged to protect the collapsible additive reservoir.

6. The arrangement according to claim 1, further comprising a regulator arrangement which is arranged to regulate the flows of the additive liquid and the base liquid to the mixing space.

7. The arrangement according to claim 6, in which the regulator arrangement is arranged so that the flows of the additive liquid and the base liquid are caused by a user providing a suction force at a closure arrangement valve passage wherein a closure arrangement valve is arranged to regulate the flow of liquid through the closure arrangement valve passage.

8. The arrangement according to claim 6, in which the regulator arrangement is arranged so that the flows of the additive liquid and the base liquid are associated or linked.

9. The arrangement according to claim 6, in which the regulator arrangement includes a base liquid regulator, in which the base liquid regulator includes a one way base liquid valve which is arranged to inhibit or prevent back flow of liquid from the closure arrangement into the base liquid container.

10. The arrangement according to claim 6, in which the regulator arrangement includes an additive liquid regulator which is arranged to inhibit or prevent back flow of liquid from the mixing space into the reservoir.

11. The arrangement according to claim 1, in which the closure arrangement includes a plurality of reservoirs, each of which stores different additive liquids.

12. The arrangement according to claim 1, in which a volume ratio of a total additive liquid(s) relative to the base liquid is predetermined and/or fixed.

13. The arrangement according to claim 6, in which the regulator arrangement includes an adjuster, which in use permits a user to adjust the amount of additive liquid(s) added to the base liquid in the mixing space to adjust the volume ratio of the total additive liquid(s) relative to the base liquid.

14. The arrangement according to claim 13 in which the closure arrangement includes an additive liquid communication tube, which extends from the reservoir toward the mixing space, in which the tube is formed of a resiliently deformable material; and in which the adjuster includes an adjuster gate formation, which is arranged to selectively deform the tubes to permit substantially no additive liquid flow in a no flow condition and a full additive liquid flow in a full flow condition.

15. The arrangement according to claim 1, in which the closure arrangement is reusable, and/or in which the reservoir can hold sufficient additive liquid for addition to a plurality of bottles of base liquid.

16. The arrangement according to claim 1, in which the closure arrangement includes a relief valve to permit the equalisation of pressure in the interior during use.

17. The arrangement according to claim 1, in which the liquid container is a drinks bottle, and in which the closure arrangement is in the form of a cap or a bottle topper.

18. A liquid container assembly, the assembly including a liquid container for a base liquid and a closure arrangement according to claim 1.

19. The arrangement according to claim 11, in which a first reservoir contains a first additive liquid and a second reservoir contains a second additive liquid, in which the ratio of the volume amount of the first additive liquid to the second additive liquid is user-adjustable.

20. The arrangement according to claim 8, in which the association or linkage is direct, so that the flows increase or reduce together.

21. The arrangement according to claim 1, in which the closure arrangement further comprises a connection part for connection to the liquid container.

* * * * *